US007967073B2

(12) United States Patent
Boutwell, Jr. et al.

(10) Patent No.: US 7,967,073 B2
(45) Date of Patent: Jun. 28, 2011

(54) CONTROL LINE RUNNING SYSTEM

(75) Inventors: Doyle Frederic Boutwell, Jr., Houston, TX (US); Karsten Heidecke, Houston, TX (US); Kevin Wood, Langenhagen (DE); Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 76 days.

(21) Appl. No.: 12/139,433

(22) Filed: Jun. 13, 2008

(65) Prior Publication Data

US 2008/0308281 A1 Dec. 18, 2008

Related U.S. Application Data

(60) Provisional application No. 60/944,465, filed on Jun. 15, 2007.

(51) Int. Cl.
*E21B 19/00* (2006.01)

(52) U.S. Cl. ..... 166/385; 166/77.1; 166/85.5

(58) Field of Classification Search ..... 166/385, 166/77.1, 85.5, 77.2
See application file for complete search history.

(56) References Cited

U.S. PATENT DOCUMENTS

| | | | | |
|---|---|---|---|---|
| 5,184,682 | A * | 2/1993 | Delacour et al. | 166/385 |
| 6,131,664 | A | 10/2000 | Sonnier | |
| 6,491,107 | B2 * | 12/2002 | Dearing et al. | 166/381 |
| 6,926,082 | B2 * | 8/2005 | Wills et al. | 166/301 |
| 7,185,708 | B2 * | 3/2007 | Wood et al. | 166/379 |
| 7,201,233 | B2 | 4/2007 | Penisson et al. | |
| 2005/0161227 | A1 * | 7/2005 | Hayes et al. | 166/380 |
| 2005/0161230 | A1 * | 7/2005 | Webre et al. | 166/384 |
| 2006/0101914 | A1 * | 5/2006 | McCoy | 73/587 |
| 2006/0231268 | A1 * | 10/2006 | Wood | 166/379 |
| 2008/0006400 | A1 | 1/2008 | Coyle, Jr. | |
| 2008/0251248 | A1 * | 10/2008 | Havinga | 166/77.3 |

FOREIGN PATENT DOCUMENTS

| | | |
|---|---|---|
| WO | WO 2005/071215 | 8/2005 |
| WO | WO 2006/058055 | 6/2006 |
| WO | WO 2007/106377 | 9/2007 |

OTHER PUBLICATIONS

PCT Search Report from Application No. PCT/US2008/067033 dated Oct. 2, 2008.
EP Office Action for Application No. 08 771 120.6—2315 dated Sep. 24, 2010.
Canadian Office Action for Application No. 2,691,146 dated Mar. 15, 2011.

* cited by examiner

*Primary Examiner* — Giovanna C Wright
(74) *Attorney, Agent, or Firm* — Patterson & Sheridan, LLP

(57) ABSTRACT

A control line running system includes a control line storage unit and a guiding system having a guiding device and a guide rail for guiding a control line from the control line storage unit toward a well center. The system may also include a control line manipulator assembly for moving the control line toward a tubular and a control line clamp for attaching the control line to the tubular.

25 Claims, 33 Drawing Sheets

CONTROL LINE RUNNING SYSTEM

CROSS-REFERENCE TO RELATED APPLICATIONS

This application claims benefit of co-pending U.S. Provisional Patent Application Ser. No. 60/944,465, filed on Jun. 15, 2007, which patent application is incorporated herein by reference in its entirety.

BACKGROUND OF THE INVENTION

1. Field of the Invention

Embodiments of the present invention relate to apparatus and methods of running a control line into and out of a well. More particularly, embodiments of the present invention relate to coupling a control line to a wellbore tubular and running the control line and the wellbore tubular into the well.

2. Description of the Related Art

Strings of pipe are typically run into a wellbore at various times during the formation and completion of a well. A wellbore is formed for example, by running a bit on the end of the tubular string of drill pipe. Later, larger diameter pipe is run into the wellbore and cemented therein to line the well and isolate certain parts of the wellbore from other parts. Smaller diameter tubular strings are then run through the lined wellbore either to form a new length of wellbore therebelow, to carry tools in the well, or to serve as a conduit for hydrocarbons gathered from the well during production.

As stated above, tools and other devices are routinely run into the wellbore on tubular strings for remote operation or communication. Some of these are operated mechanically by causing one part to move relative to another. Others are operated using natural forces like differentials between downhole pressure and atmospheric pressure. Others are operated hydraulically by adding pressure to a column of fluid in the tubular above the tool. Still others need a control line to provide either a signal, power, or both in order to operate the device or to serve as a conduit for communications between the device and the surface of the well. Control lines (also known as umbilical cords) can provide electrical, hydraulic, or fiber optic means of signal transmission, control and power.

Because the interior of a tubular string is generally kept clear for fluids and other devices, control lines are often run into the well along an outer surface of the tubular string. For example, a tubular string may be formed at the surface of a well and, as it is inserted into the wellbore, a control line may be inserted into the wellbore adjacent the tubular string. The control line is typically provided from a reel or spool somewhere near the surface of the well and extends along the string to some component disposed in the string. Because of the harsh conditions and non-uniform surfaces in the wellbore, control lines are typically fixed to a tubular string along their length to keep the line and the tubular string together and prevent the control line from being damaged or pulled away from the tubular string during its trip into the well.

Control lines are typically attached to the tubular strings using clamps placed at predetermined intervals along the tubular string by an operator. Because various pieces of equipment at and above well center are necessary to build a tubular string and the control line is being fed from a remotely located reel, getting the control line close enough to the tubular string to successfully clamp it prior to entering the wellbore is a challenge. In one prior art solution, a separate device with an extendable member is used to urge the control line towards the tubular string as it comes off the reel. Such a device is typically fixed to the derrick structure at the approximate height of intended engagement with a tubular traversing the well center, the device being fixed at a significant distance from the well center. The device is telescopically moved toward and away from well center when operative and inoperative respectively. The device must necessarily span a fair distance as it telescopes from its out of the way mounting location to well center. Because of that the control line-engaging portion of the device is difficult to locate precisely at well center. The result is often a misalignment between the continuous control line and the tubular string making it necessary for an operator to manhandle the control line to a position adjacent the tubular before it can be clamped.

Another challenge to managing the control lines is the accidental closing of the slips around the control lines. Typically, while the control line is being clamped to the tubular string, the slips are open to allow the string and the newly clamped control line to be lowered into the wellbore. When the control line is near the tubular string, it is exposed to potential damage by the slips. Thus, if the slips are prematurely closed, the slips will cause damage to the control line. Other challenges include running multiple control lines and keeping track of the respective function or downhole tool for each control line. Running of the control line may also present a safety hazard because sometimes an operator may be required to be hoisted on to the derrick to manage the control line.

There is a need therefore for an apparatus to facilitate running of the control line into and out of a well. There is also a need to for an apparatus to facilitate the clamping of control line to a tubular string at the surface of a well and running the tubular string and the control line into the well.

SUMMARY OF THE INVENTION

In one embodiment, a control line running system includes a control line storage unit and a guiding system having a guiding device and a guide rail for guiding a control line from the control line storage unit toward a well center. The system may also include a control line manipulator assembly for moving the control line toward a tubular and a control line clamp for attaching the control line to the tubular.

In another embodiment, an apparatus for running a control line includes a guide rail and a guiding device having a channel for retaining the control line, wherein the guiding device is movable along the guide rail to position the control line at a predetermined location.

In yet another embodiment, an apparatus for installing a clamp on a tubular includes an arm support; an arm disposed on an end of the arm support; and a gripping element attached to the arm, wherein the arm is movable relative to the arm support to move the gripping element into engagement with the clamp.

In yet another embodiment, a method for guiding a control line includes inserting the control line into a guiding device and moving the guiding device along a rail to position the control line at a predetermined location.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments and are therefore not to be considered limiting of scope, for the invention may admit to other equally effective embodiments.

DETAILED DESCRIPTION OF A PREFERRED EMBODIMENT

Embodiments of the present invention provide apparatus and methods for running a control line into and out of a well. In one embodiment, a guiding system is provided to guide or steer a control line from a spool into and around a rig floor to a control line manipulating assembly. The manipulating assembly may then position the control line for installation to the tubular string and for running into the well.

Embodiments of the present invention may be used to run any suitable control line. Exemplary control lines (also known as umbilical cords or parasitic strings) may provide electrical, hydraulic, pneumatic, chemical, or fiber optic means of signals transmission, control, power, data communication, and combinations thereof. Suitable control lines include electrical cable, hydraulic line, chemical injection lines, small diameter pipe, fiber optics, and coiled tubing.

Feeding Assembly

Figure 1:
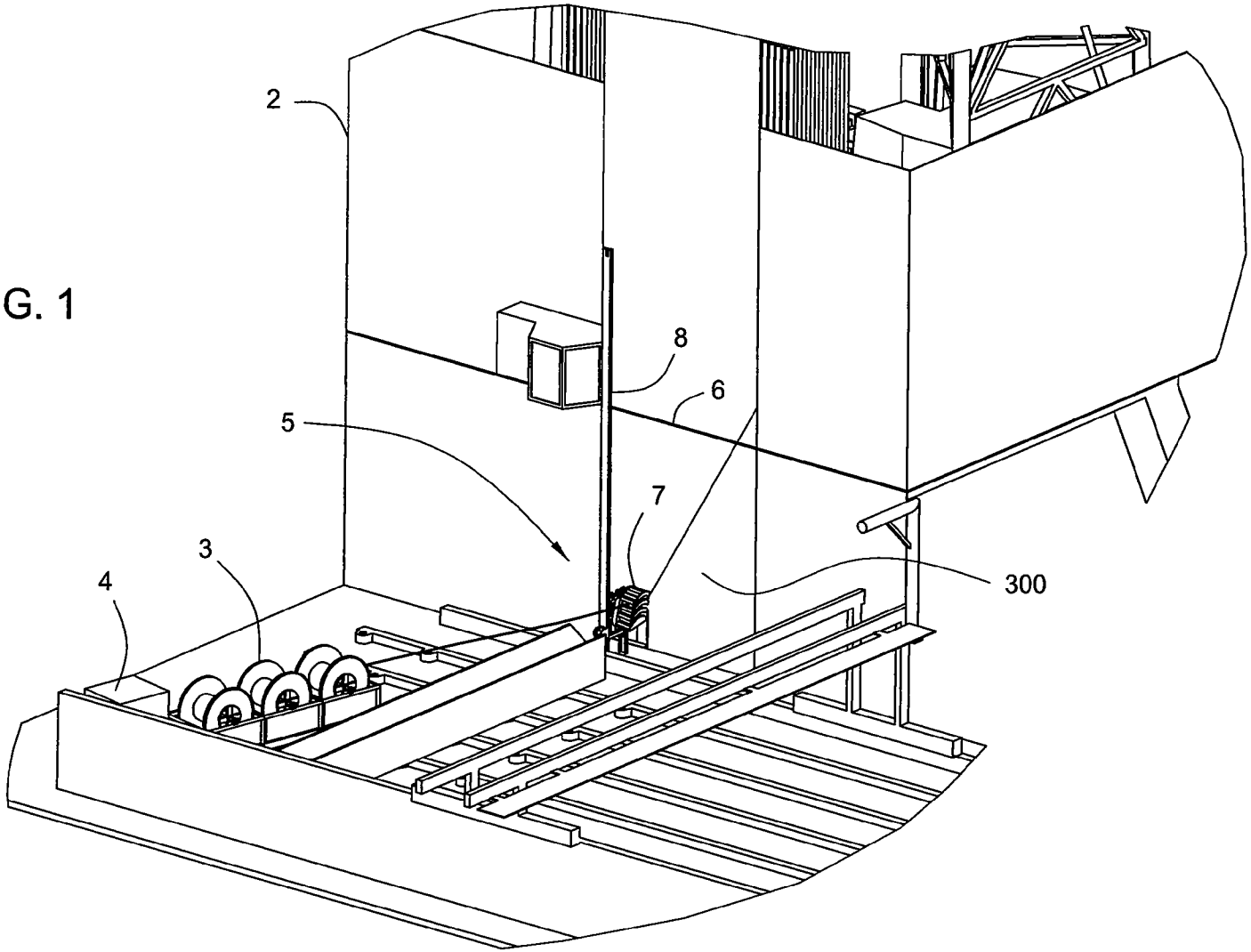
FIGS. 1 and 2 show a control line guiding system 5 for guiding or steering one or more control lines 300 into and around the rig.
Figure 2:
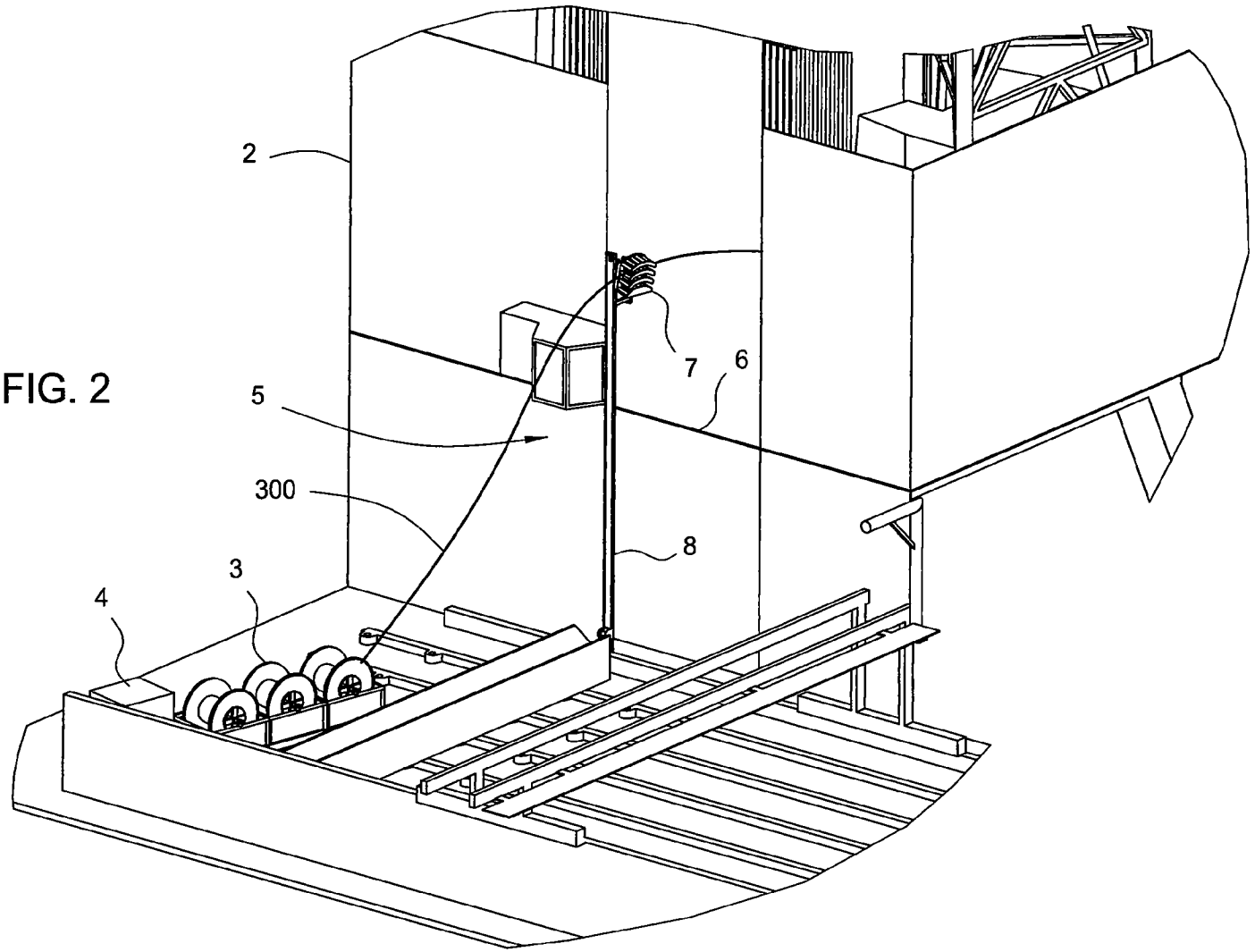

FIGS. 1 and 2 show a control line feeding system disposed adjacent the entrance of a rig 2. The feeding system includes one or more modular spool cartridges 3 for storing a control line 300. The modularity of the cartridges 3 allows versatile placement of each cartridge 3 to optimize rig space and functionality with respect to each downhole tool installed in the tubular string. The control line 300 may have a free end for connection to the downhole tool on the rig 2 or be pre-connected to the downhole tool.

The feeding system may also include a control panel 4 to provide individual control of each spool cartridge 3. The control panel 4 may be adapted to monitor and control line tension, feed rate in the forward or reverse directions, power condition and supply for one or more control lines, and other suitable control parameters. Maintaining tension on the control line 300 allows the control line 300 to move off the spool 3 as it is urged away from the spool 3 while permitting the spool 3 to keep some tension on the control line 300 and avoiding unnecessary slack. The control panel 4 and spool cartridges 3 may be compatible with all power sources, including air, hydraulics, electric, and combinations thereof. In one embodiment, the control panel 4 may be remotely connected to the modular spool cartridges 3 to optimize work space or operational efficiency for deployment of the control lines 300.

Control Line Guiding System

FIGS. 1 and 2 also show a control line guiding system 5 for guiding or steering one or more control lines 300 into and around the rig. The guiding system 5 may be configured to guide the control line 300 toward a control line manipulating system 50 for handling with respect to a tubular string. In one embodiment, an elevation guiding device 7 is mounted on a guide rail system 8 that will allow vertical movement of the elevation guiding device 7. The guide rail system may also direct lateral positioning of the elevation guiding device 7. In this respect, the guide rail system 8 may be used to position the control line 300 at the optimum working height or location for a particular application. Also, the elevation guiding device 7 may be lowered to facilitate coupling of the control line 300 to the elevation guiding device 7. Further, the elevation guiding device 7 may be pivoted horizontally or vertically relative to the guide rail. FIG. 1 shows the elevation guiding device 7 in a lowered position, such as below the rig floor 6, and FIG. 2 shows the elevation guiding device 7 in a raised position, such as above the rig floor 6. The guide rail system 8 may be installed at any suitable location for guiding the control line 300 toward the manipulating system 50. For example, the guide rail system 8 may be positioned adjacent the entrance into the rig 2.

In one embodiment, the elevation guiding device 7 may have one or more channels for guiding one or more control lines. As shown, the elevation guiding device 7 has four dividers to provide three channels and the control line 300 is positioned in the uppermost channel. The dividers may have a plurality of rollers to facilitate movement of the control line 300 through the channels. The channels or rollers may be adjustable to accommodate different sizes of control lines. In one embodiment, the dividers may provide an arcuate surface for supporting the control line. In another embodiment, each divider may include only a single roller. In yet another embodiment, the channels are not gated so as to facilitate insertion of a control line into the channel, especially if the control line is pre-connected to a downhole tool. In yet another embodiment, the channels may be gated. The rollers may be separable to facilitate insertion of a control line. In FIG. 1, the channels are configured so that the control line 300 may be positioned in the channel without having to insert the front end of the control line 300 through the channel. Alternatively, the channel is adapted to allow insertion of the control line in a direction substantially transverse to a longitudinal axis of the control line. This configuration is particularly useful if the front end of the control line 300 is pre-attached to a downhole tool. Although the channels are shown as being above each other, it is also contemplated that the channels may be to the right or left of each other or positioned at an angle relative to each other. It is further contemplated that any suitable number of channels may be provided on the guiding device. In another embodiment, the plurality of channels may be used to run multiple control lines. Additionally, the plurality of channels may be used to identify and sort the control lines based on the channel in which the control line is located.

Figure 3A:
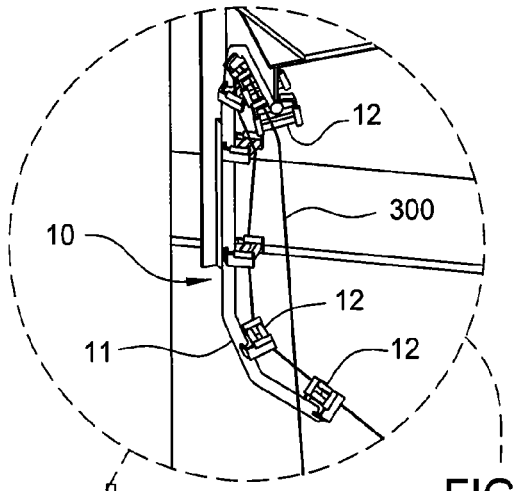
FIGS. 3-14 show an exemplary control line running operation.
Figure 3:
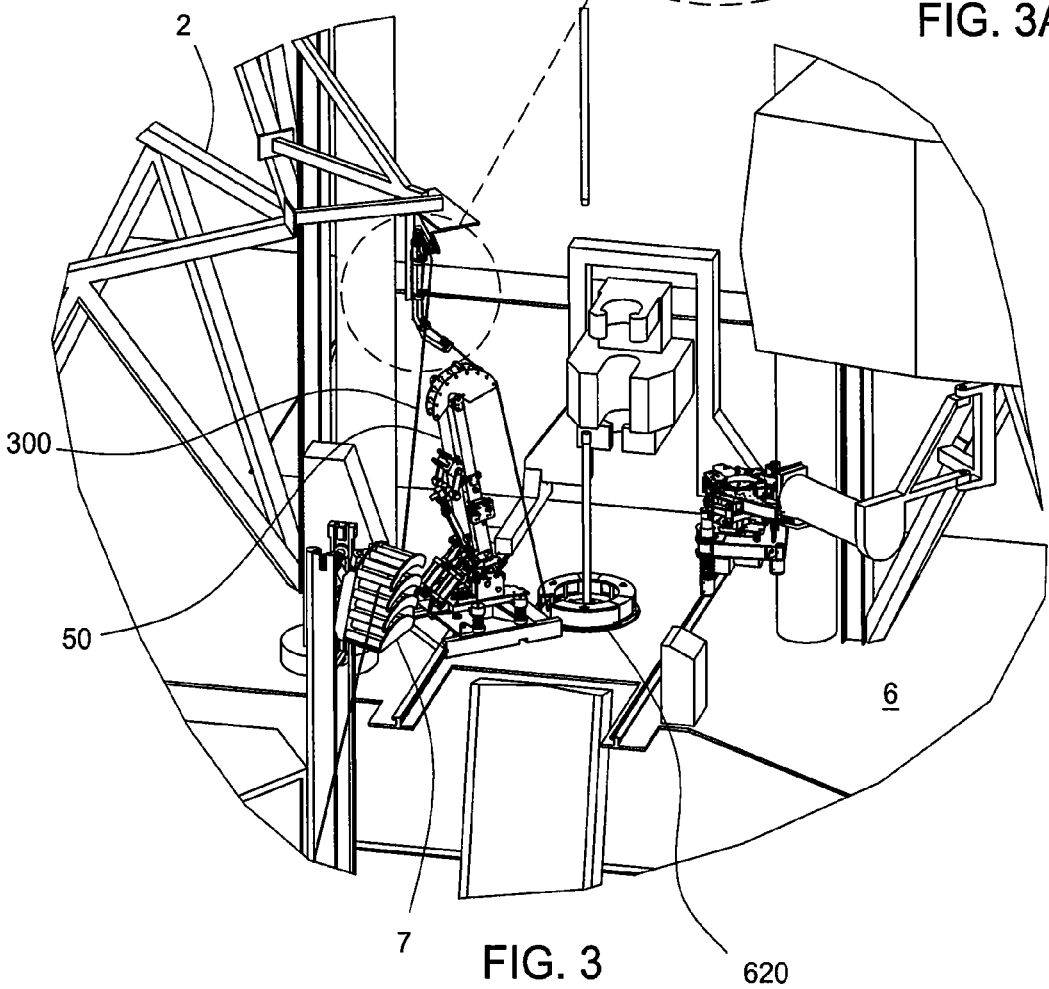

The control line guiding system 5 may further include a directional guiding device 10, as shown in FIG. 3. As shown, the directional guiding device 10 is attached to the rig 2 and positioned to direct the control line 300 toward the manipulating assembly 50. The location of the direction guiding device 10 may be determined from a survey of the tools such as elevators, spiders, and tongs located on the rig. The directional guiding device 10 is adapted to redirect the control line 300 from the elevation guiding device 7 toward the manipulating assembly 50. Because some control lines have limited flexibility, the directional guiding device 10 provides a gradual transition of the control line path toward the manipulating assembly 50. In one embodiment, the control line 300 may be guided by a plurality of roller sets 12 disposed along a directional arm 11. Each set of rollers 12 may include two rollers, and the control line 300 is disposed between the two rollers 12. The roller sets 12 may be opened to facilitate positioning of the control line 300 between the two rollers 12. However, it is also contemplated that the control line maybe inserted between the two rollers without opening them. In yet another embodiment, the two rollers 12 may be supported on the directional arm 11 in a cantilevered structure. In this respect, an opening is formed between the two rollers 12 to insert the control line 300 between the two rollers. The cantilever structure may be pivotable such that the rollers may be pivoted relative to each other to enlarge the opening for positioning the control line therebetween. Additionally, it is contemplated that the directional guiding device 10 may be used without the elevation guiding device 7. It is further contemplated that a plurality of directional guiding devices 10 may be used to direct a control line 300 toward the well. In one embodiment, the directional guiding device may be coupled to an extendible member such as a piston and cylinder assembly so that the device may be lowered toward the rig floor to facilitate coupling to the control line. In another embodiment, the directional guiding device may be adapted to pivot in one or more planes in order to adjust the directional angle of guiding arm.

In another embodiment, the control line guiding system may be positioned below a rig floor to route a control line up through a hole in the rig floor. The hole may be located proximate the well center so that the control line may be clamped to the tubular string by the control line manipulating assembly. In this respect, the control line may avoid the tools located on the rig floor. Alternatively, The hole may be located away from the well center to accommodate the curvature of the control lines and away from other equipment, such as blow out preventors.

Control Line Manipulating Assembly

Figure 15:
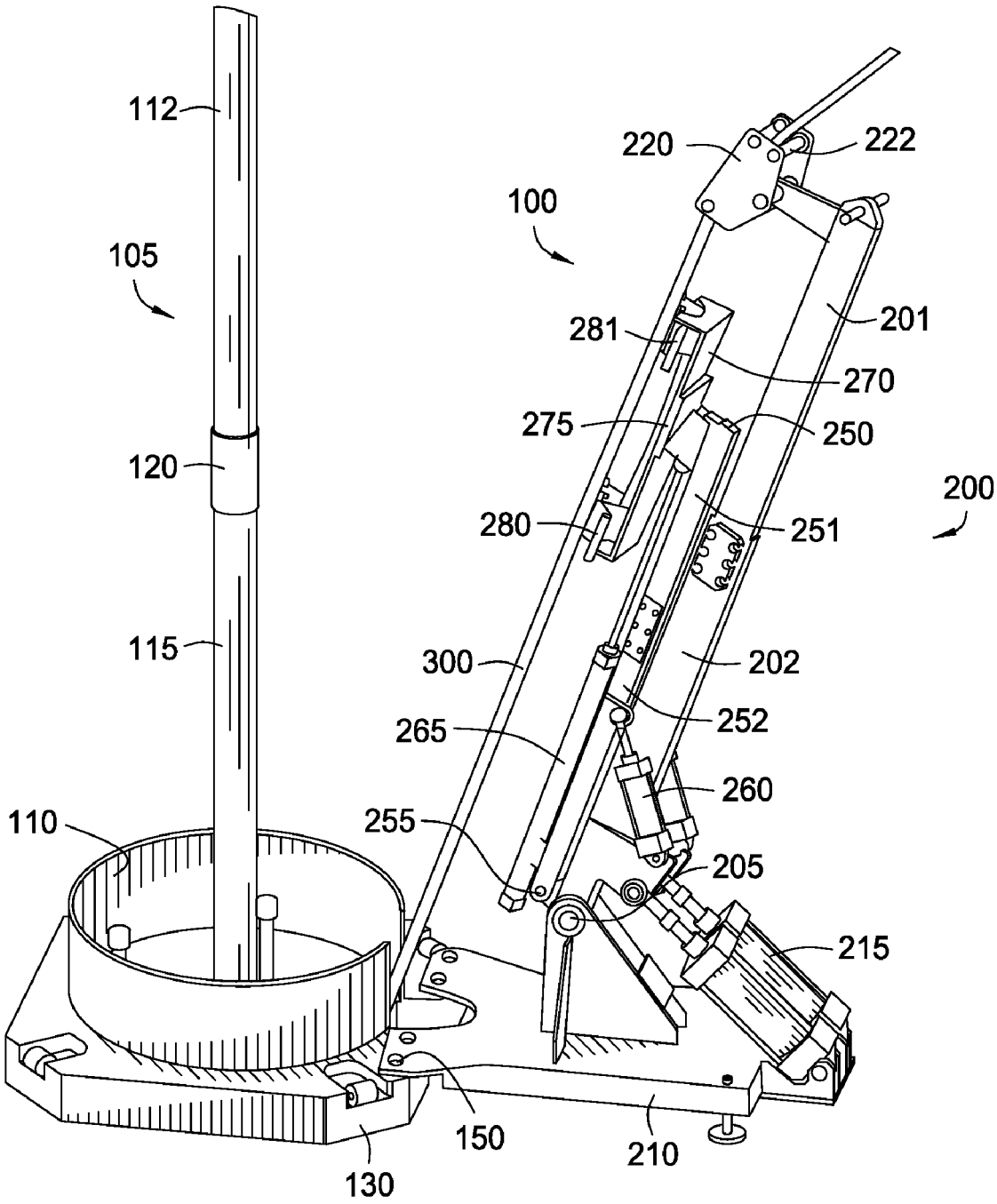
FIG. 15 illustrates one embodiment of an assembly used to facilitate the clamping of a control line to a tubular string.

FIG. 15 illustrates one embodiment of a manipulating assembly 100 used to control movement of the control line 300 relative to a tubular string 105 and to facilitate the clamping of a control line 300 to a tubular string 105. The assembly 100 is movable between a staging position and a clamping position. As shown, the assembly 100 is located adjacent the surface of a well 110. Extending from the well 110 is the tubular string 105 comprising a first 112 and a second 115 tubulars connected by a coupling 120. Not visible in FIG. 15 is a spider which consists of slips that retain the weight of the tubular string 105 at the surface of the well 110. Also not shown is an elevator or a spider which would typically be located above the rig floor or work surface to carry the weight of the tubular 112 while the tubular 112 is aligned and threadedly connected to the upper most tubular 115 to increase the length of tubular string 105. The general use of spiders and elevators to assemble strings of tubulars is well known and is shown in U.S. Publication No. US-2002/0170720-A1, which is incorporated herein by reference in its entirety.

The assembly 100 includes a guide boom 200 or arm, which in one embodiment is a telescopic member made up of an upper 201 and a lower 202 boom. Guide boom 200 is mounted on a base 210 or mounting assembly at a pivot point 205. Typically, the guide boom 200 extends at an angle relative to the base 210, such as an angle greater than 30 degrees. A pair of fluid cylinders 215 or motive members permits the guide boom 200 to move in an arcuate pattern around the pivot point 205. Visible in FIG. 15 is a spatial relationship between the base 210 and a platform table 130. Using a fixing means, such as pins 150, the base 210 is fixed relative to the table 130, thereby permitting the guide boom 200 to be fixed relative to the tubular string 105 extending from the well 110, and preferably, the guide boom 200 is fixed relatively proximate the tubular string 105 or well center. In this manner, the vertical center line of the guide boom 200 is substantially aligned with the vertical center line of the tubular string 105. Also, as the guide boom 200 pivots around the pivot point 205 to approach the tubular string 105 (see FIG. 16), the path of the boom 200 and the tubular string 105 will reliably intersect. This helps ensure that the control line 300 is close enough to the string 105 for a clamp 275 to be manually closed around the string 105 as described below. In another embodiment, the guide boom 200 may be adapted to move laterally to or away from the tubular string instead of an arcuate motion. In another embodiment, the base 210 may be positioned on a track so that assembly 100 may move toward or away from the well 110.

As shown in FIG. 15, a guide 220 or a control line holding assembly is disposed at an upper end of guide boom 200. The guide boom 220 has a pair of rollers 222 mounted therein in a manner which permits the control line 300 to extend through the rollers 222. It must be noted that any number of rollers or smooth surface devices may be used to facilitate movement of the control line 300. In one embodiment, the guide 220 may have an arcuate shaped head for engaging the control line 300. An exemplary arcuate guide is shown as the clamp head 307 in FIG. 15.

Also visible in FIG. 15 is a clamp boom 250 or arm, which in one embodiment is a telescopic member made up of an upper 251 and a lower 252 boom. The clamp boom 250 is mounted substantially parallel to the guide boom 200. The clamp boom 250 includes a pivot point 255 adjacent the pivot point 205 of guide boom 200. The clamp boom 250 is moved by one or more fluid cylinders. For instance, a pair of fluid cylinders 260 moves the clamp boom 250 around the pivot point 255 away from the guide boom 200. Another fluid cylinder 265 causes the clamp boom 250 to lengthen or shorten in a telescopic fashion. Since the clamp boom 250 is arranged similarly to the guide boom 200, the clamp boom 250 also shares a center line with the tubular string 105. As defined herein, a fluid cylinder may be hydraulic or pneumatic. Alternatively, the booms 200, 250 may be moved by another form of a motive member such as a linear actuator, an electric or fluid operated motor or any other suitable means known in the art. In another embodiment, the booms 200, 250 may be manually moved.

Figure 17:
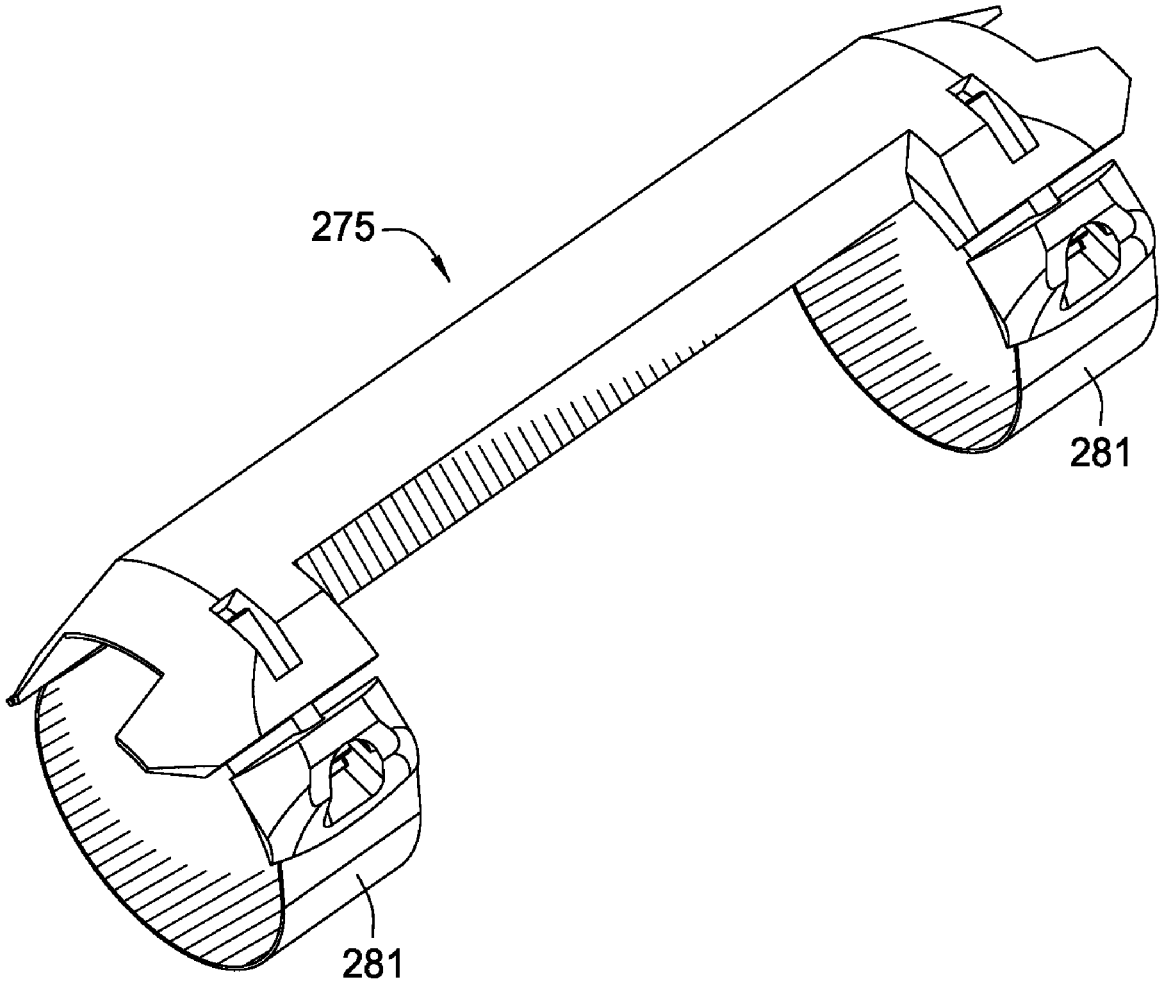
FIG. 17 is a detailed view of an exemplary clamp.

As shown in FIG. 15, a clamp holding assembly comprising a clamp housing 270 and a removable clamp 275 is disposed at an end of the clamp boom 250. The removable clamp 275 includes a first clamp member 280 and a second clamp member 281 designed to reach substantially around and embrace a tubular member, clamping, or securing a control line together with the tubular member. More specifically, the clamp 275 is designed to straddle the coupling 120 between two tubulars 112, 115 in the tubular string 105. For example, in the embodiment of FIG. 15, the clamp 275 is designed such that one clamp member 281 will close around the lower end of tubular 112 and another clamp member 280 will close around an upper end of tubular 115, thereby straddling the coupling 120. A frame portion between the clamp members 280, 281 covers the coupling 120. The result is a clamping arrangement securing the control line 300 to the tubular string 105 and providing protection to the control line 300 in the area of coupling 120. A more detailed view of the clamp 275 is shown in FIG. 17. In the preferred embodiment, the clamp 275 is temporarily held in the clamp housing 270 and then is releasable therefrom.

Figure 16:
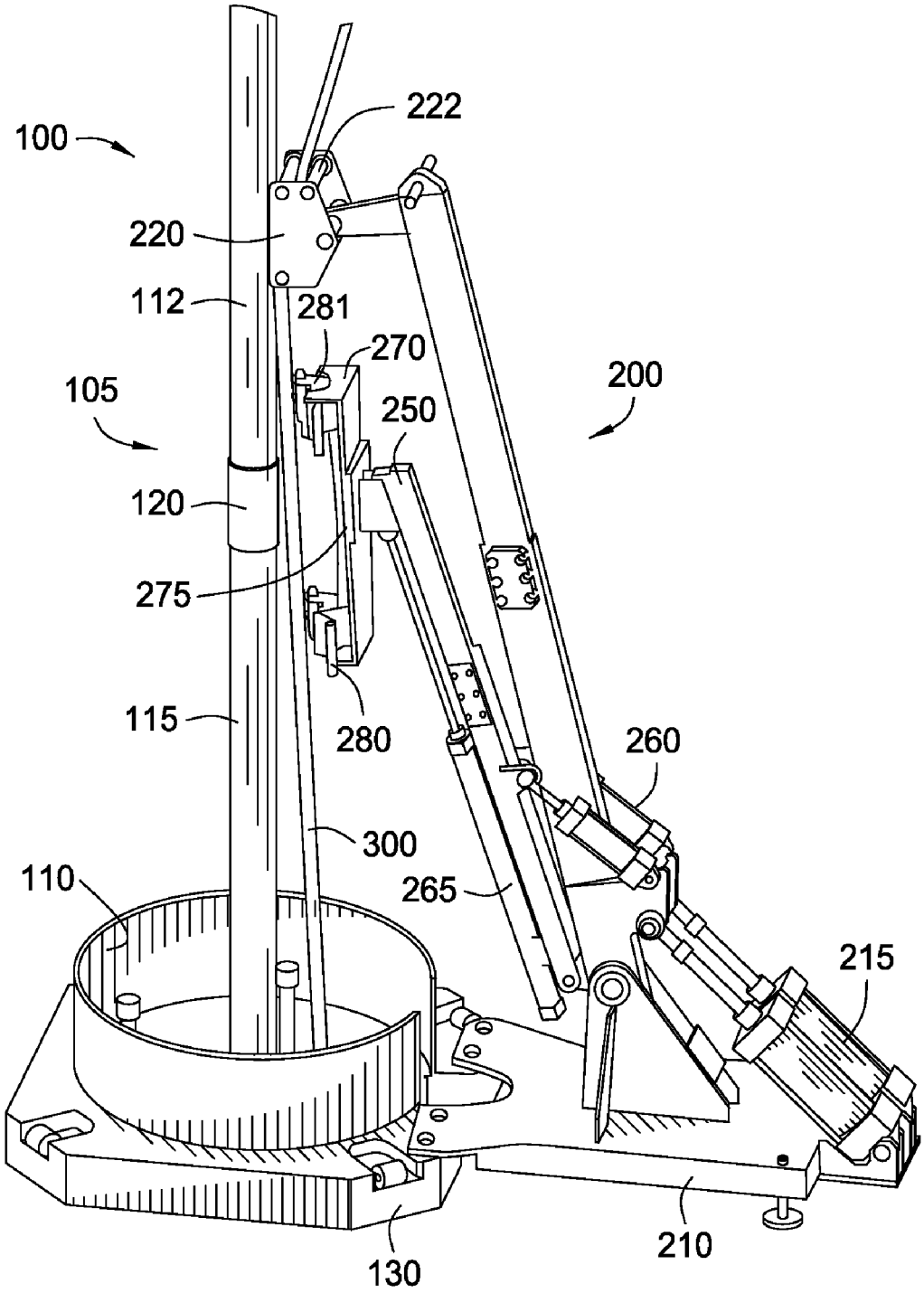
FIG. 16 illustrates the assembly of FIG. 15 in a position whereby the control line has been brought to a location adjacent the tubular string for the installation of a clamp.

FIG. 16 illustrates the assembly 100 in a position adjacent the tubular string 105 with the clamp 275 ready to engage the tubular string 105. Comparing the position of the assembly 100 in FIG. 16 with its position in FIG. 15, the guide boom 200 and the clamp boom 250 have both been moved in an arcuate motion around pivot point 205 by the action of fluid cylinders 215. Additionally, the cylinders 260 have urged the clamp boom 250 to pivot around the pivot point 255. The fluid cylinder 265 remains substantially in the same position as in FIG. 15, but as is apparent in FIG. 16, could be adjusted to ensure that coupling 120 is successfully straddled by the clamp 275 and that clamp members 280, 281 may be secured around tubulars 112 and 115, respectively. In FIG. 16, the guide 220 is in close contact with or touching tubular 112 to ensure that the control line 300 is running parallel and adjacent the tubular string 105 as the clamp boom 250 sets up the clamp 275 for installation. The quantity of control line 300 necessary to assume the position of FIG. 16 is removed from the pretensioned reel as previously described.

Still referring to FIG. 16, the clamp boom 250 is typically positioned close to the tubular string 105 by manipulating fluid cylinders 260 until the clamp members 280, 281 of the clamp 275 can be manually closed by an operator around tubulars 112 and 115. Thereafter, the clamp 275 is removed from the housing 270 either manually or by automated means and the assembly 100 can be retracted back to the position of FIG. 16. It should be noted that any number of clamps can be installed on the tubular string 105 using the assembly 100, and the clamps do not necessarily have to straddle a coupling.

In operation, the tubular string 105 is made at the surface of the well with subsequent pieces of tubular being connected together utilizing a coupling. Once a "joint" or connection between two tubulars is made, the tubular string 105 is ready for control line 300 installation before the tubular string 105 is lowered into the wellbore to a point where a subsequent joint can be assembled. To install the control line 300, the guide boom 200 and the clamp boom 250 are moved in an arcuate motion to bring the control line 300 into close contact and alignment with the tubular string 105. Thereafter, the cylinders 260 operating the clamp boom 250 are manipulated to ensure that the clamp 275 is close enough to the tubular string 105 to permit its closure by an operator and/or to ensure that the clamp members 280, 281 of the clamp 275 straddle the coupling 120 between the tubulars. In another embodiment, the guide boom 200 and/or the clamp boom 250 may be provided with one or more sensors to determine the position of the coupling 120 relative to the clamp members 280, 281. In this respect, the clamp members 280, 281 may be adjusted to ensure that they straddle the coupling 120. In another embodiment, the draw works may be adapted to position the elevator at a predetermined position such that the clamp member 280, 281 will properly engage the coupling 120. In another embodiment still, the proper position of the elevator may be adjusted during operation and thereafter memorized. In this respect, the memorized position may be "recalled" during operation to facilitate positioning of the elevator. It must be noted that other top drive components such as a torque head or spear may be used as reference points for determining the proper position of the coupling 120 such that their respective positions may be memorized or recalled to position the coupling 120.

After the assembly 100 is positioned to associate the clamp 275 with tubular string 105, an operator closes the clamp members 280, 281 around the tubulars 112, 115, thereby clamping the control line 300 to the tubulars 112, 115 in such a way that it is held fast and also protected, especially in the area of the coupling 120. Thereafter, the removable clamp 275 is released from the clamp housing 270. The assembly 100 including the guide boom 200 and the clamp boom 250 is retracted along the same path to assume a retracted position like the one shown in FIG. 16. The tubular string 105 may now be lowered into the wellbore along with the control line 300 and another clamp 275 may be loaded into the clamp housing 270.

In one embodiment, the guide boom and the clamp boom fluid cylinders are equipped with one or more position sensors which are connected to a safety interlock system such that the spider cannot be opened unless the guide boom and the clamp boom are in the retracted position. Alternatively, such an interlock system may sense the proximity of the guide boom and clamp boom to the well center, for example, by either monitoring the angular displacement of the booms with respect to the pivot points or using a proximity sensor mounted in the control line holding assembly or the clamp holding assembly to measure actual proximity of the booms to the tubular string. In one embodiment, regardless of the sensing mechanism used, the sensor is in communication with the spider and/or elevator (or other tubular handling device) control system. The control system may be configured to minimize the opportunity for undesirable events and potential mishaps to occur during the tubular and control line running operation. Examples of such events/mishaps include, but are not limited to: a condition in which the spider and elevator are both released from the tubular string, resulting in the tubular string being dropped into the wellbore; interference between the gripping elements of either the spider or elevator with the control line; interference between either the spider or elevator and the control line positioning apparatus; interference between either the spider or elevator and the control line clamp positioning apparatus; interference between either the spider or elevator and a tubular make-up tong; interference between a tubular make-up tong and either the control line positioning apparatus and/or the control line clamp positioning apparatus, and/or the control line itself. Hence the safety interlock and control system provide for a smooth running operation in which movements of all equipment (spider, elevator, tongs, control line positioning arm, control line clamp positioning arm, etc.) are appropriately coordinated.

Such an interlock system may also include the rig draw works controls. The aforementioned boom position sensing mechanisms may be arranged to send signals (e.g., fluidic, electric, optic, sonic, or electromagnetic) to the draw works control system, thereby locking the draw works (for example, by locking the draw works brake mechanism in an activated position) when either the control line or clamp booms are in an operative position. In this respect, the tubular string may be prevented from axial movement. However, it must noted that the boom position sensing mechanisms may be adapted to allow for some axial movement of the draw works such that the tubular string's axial position may be adjusted to ensure the clamp members straddle the coupling. Some specific mechanisms that may be used to interlock various tubular handling components and rig devices are described in U.S. Publication No. US-2004/00069500 and U.S. Pat. No. 6,742,596 which are incorporated herein in their entirety by reference.

Figure 18:
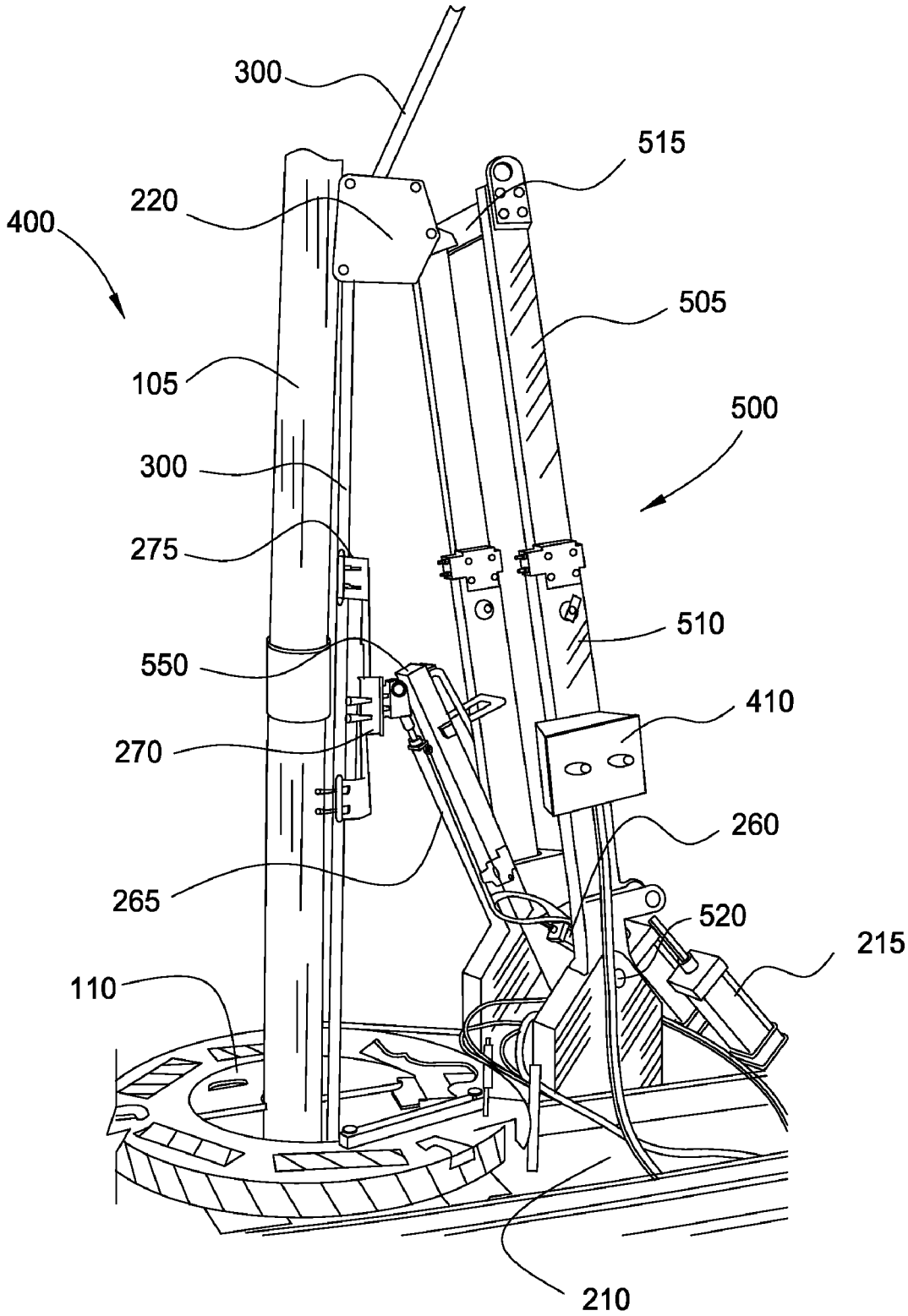
FIG. 18 illustrates another embodiment of an assembly used to facilitate the clamping of the control line to tubular string.

FIG. 18 illustrates another embodiment of an assembly 500 used to facilitate the clamping of the control line 300 to the tubular string 115. For convenience, the components in the assembly 400 that are similar to the components in the assembly 100 will be labeled with the same number indicator.

As illustrated, the assembly 400 includes a guide boom 500. The guide boom 500 operates in a similar manner as the guide boom 200 of assembly 100. However, as shown in FIG. 18, the guide boom 500 has a first boom 505 and a second boom 510 that are connected at an upper end thereof by a member 515. The member 515 supports the guide 220 at an end of the guide boom 500. Additionally, the guide boom 500 is mounted on the base 210 at pivot points 520. Similar to assembly 100, the pair of fluid cylinders 215 permits the guide boom 500 to move in an arcuate pattern around pivot points 520. In one embodiment, each boom 505, 510 may include an upper and a lower boom which are telescopically related to each other to allow the guide boom 500 to be extended and retracted in a telescopic manner.

Also visible in FIG. 18 is a clamp boom 550, which in one embodiment is a telescopic member made from an upper and a lower boom. The clamp boom 550 extends at an angle relative to the base 210. In one embodiment, the clamp boom 550 is movable at least 100 degrees, or the clamp boom 550 may be adapted to move in any suitable angle. The clamp boom 550 is mounted between the booms 505, 510 of the guide boom 500. The clamp boom 550 having a pivot point (not shown) adjacent the pivot points 520 of guide boom 500. Typically, the clamp boom 550 is manipulated by a plurality of fluid cylinders. For instance, a pair of fluid cylinders (not shown) causes the clamp boom 550 to move around the pivot point. Another fluid cylinder 265 causes the clamp boom 550 to lengthen or shorten in a telescopic fashion. The clamp boom 550 is positioned adjacent the tubular string 105 so that the clamp boom 550 shares a center line with the tubular string 105. In a similar manner as the clamp boom 250 in assembly 100, the clamp boom 550 includes the clamp assembly comprising the clamp housing 270 and the removable clamp 270 disposed at an end thereof.

Similar to the operation of assembly 100, the guide boom 500 and the clamp boom 550 of the assembly 400 are moved in an arcuate motion bringing the control line 300 into close contact and alignment with the tubular string 105. Thereafter, the cylinders 260 operating the clamp boom 550 are manipulated to ensure that the clamp 275 is close enough to the tubular string 105 to permit its closure by an operator.

After the assembly 400 is positioned adjacent the tubular string 105, the operator closes the clamp 275 around the tubular string 105 and thereby clamps the control line 300 to the tubular string 105 in such a way that it is held fast and also protected, especially if the clamp 275 straddles a coupling in the tubular string 105. Thereafter, the clamp boom 550 may be moved away from the control line 300 through a space defined by the booms 505, 510 of the guide boom 500 to a position that is a safe distance away from the tubular string 105 so that another clamp 275 can be loaded into the clamp housing 270.

The manipulation of either assembly 100 or assembly 400 may be done manually through a control panel 410 (shown on FIG. 18), a remote control console or by any other means know in the art. The general use of a remote control console is shown in U.S. Publication No. US-2004/0035587-A1, which has been incorporated herein by reference.

In one embodiment a remote console (not shown) may be provided with a user interface such as a joystick which may be spring biased to a central (neutral) position. When the operator displaces the joystick, a valve assembly (not shown) controls the flow of fluid to the appropriate fluid cylinder. As soon as the joystick is released, the appropriate boom stops in the position which it has obtained.

The assembly 100, 400 typically includes sensing devices for sensing the position of the boom. In particular, a linear transducer is incorporated in the various fluid cylinders that manipulate the booms. The linear transducers provide a signal indicative of the extension of the fluid cylinders which is transmitted to the operator's console.

In operation, the booms (remotely controllable heads) are moved in an arcuate motion bringing the control line into close contact and alignment with the tubular string. Thereafter, the cylinders operating the clamp boom are further manipulated to ensure that the clamp is close enough to the tubular string to permit the closure of the clamp. When the assembly is positioned adjacent the tubular string, the operator presses a button marked "memorize" on the console.

The clamp is then closed around the tubular string to secure the control line to the tubular string. Thereafter, the clamp boom and/or the guide boom are retracted along the same path to assume a retracted position. The tubular string can now be lowered into the wellbore along with the control line and another clamp can be loaded into the clamp housing.

After another clamp is loaded in the clamp housing, the operator can simply press a button on the console marked "recall" and the clamp boom and/or guide boom immediately moves to their memorized position. This is accomplished by a control system (not shown) which manipulates the fluid cylinders until the signals from their respective linear transducers equal the signals memorized. The operator then checks the alignment of the clamp in relation to the tubular string. If they are correctly aligned, the clamp is closed around the tubular string. If they are not correctly aligned, the operator can make the necessary correction by moving the joystick on his console. When the booms are correctly aligned the operator can, if he chooses, update the memorized position. However, this step may be omitted if the operator believes that the deviation is due to the tubular not being straight.

While the foregoing embodiments contemplate fluid control with a manual user interface (i.e. joy stick) it will be appreciated that the control mechanism and user interface may vary without departing from relevant aspects of the inventions herein. Control may equally be facilitated by use of linear or rotary electric motors. The user interface may be a computer and may in fact include a computer program having an automation algorithm. Such a program may automatically set the initial boom location parameters using boom position sensor data as previously discussed herein. The algorithm may further calculate boom operational and staging position requirements based on sensor data from the other tubular handling equipment and thereby such a computer could control the safety interlocking functions of the tubular handling equipment and the properly synchronized operation of such equipment including the control line and clamp booms.

The aforementioned safety interlock and position memory features can be integrated such that the booms may automatically return to their previously set position unless a signal from the tubular handling equipment (e.g. spider/elevator, draw works) indicates that a reference piece of handling equipment is not properly engaged with the tubular.

While the assembly is shown being used with a rig having a spider in the rig floor, it is equally useful in situations when the spider is elevated above the rig floor for permit greater access to the tubular string being inserted into the well. In those instances, the assembly could be mounted on any surface adjacent to the tubular string. The general use of such an elevated spider is shown in U.S. Pat. application Ser. No. 6,131,664, which is incorporated herein by reference. As shown in FIG. 16 of the '664 patent, the spider is located on a floor above the rig floor that is supported by vertical support members such as walls, legs, or other suitable support members. In this arrangement, the apparatus may be mounted on the underside of the floor supporting the spider or on one of the support members.

Various modifications to the embodiments described are envisaged. For example, the positioning of the clamp boom to a predetermined location for loading a clamp into the clamp housing could be highly automated with minimal visual verification. Additionally, as described herein, the position of the booms is memorized electronically, however, the position of the booms could also be memorized mechanically or optically.

Control line Clamp Installation System

In another embodiment, a clamp installation system may be used with a control line manipulating system to install the clamp around the control line and the tubular string. In one embodiment, the clamp installation process may be automated or remotely controlled so that operation personnel may be located at a safe distance during operations.

Figure 19:
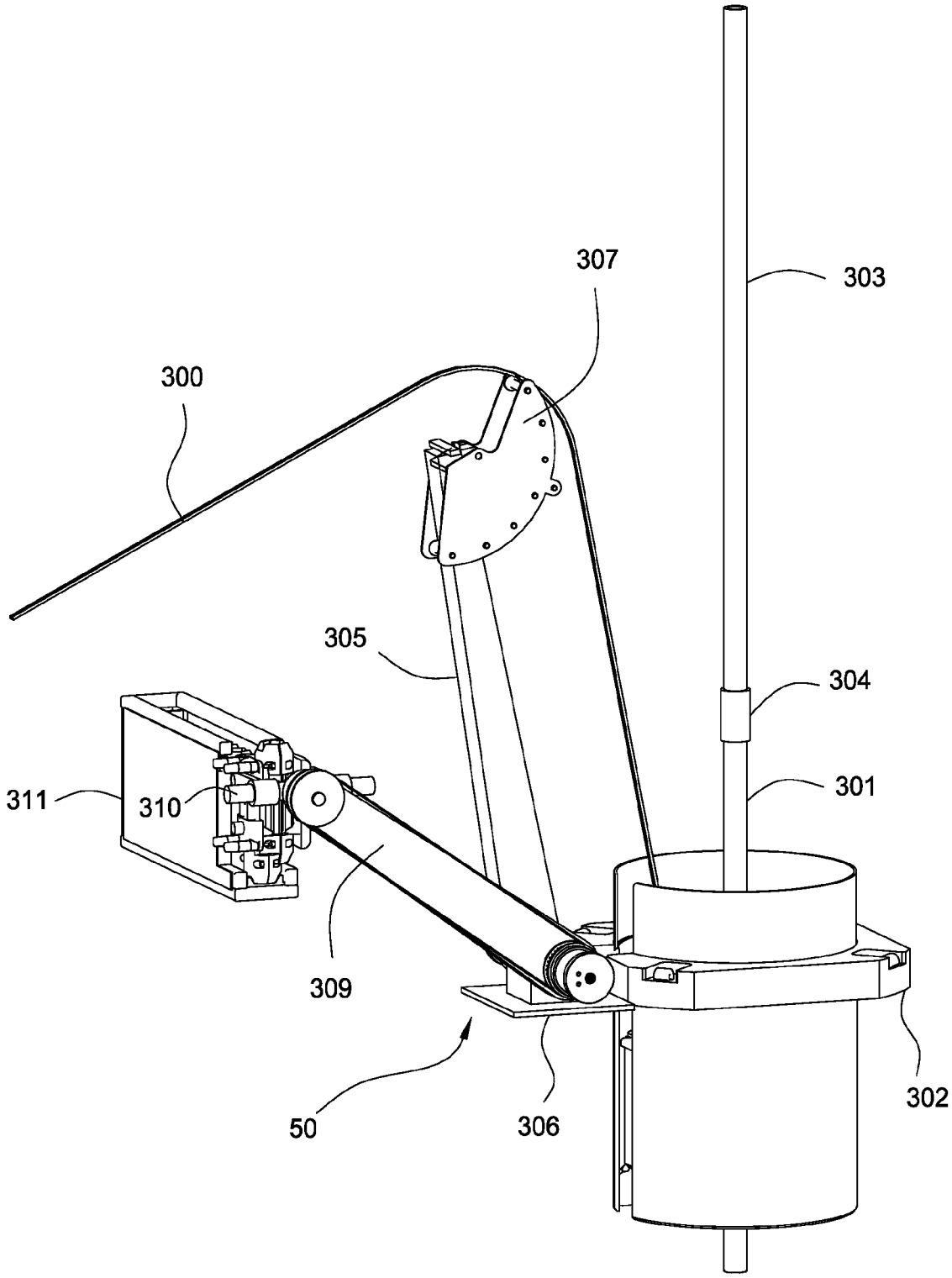
FIG. 19 shows an embodiment of a control line clamp manipulator.

FIG. 19 shows an embodiment of a control line clamp manipulator 50 ("clamp manipulator"). In FIG. 19, a pipe string 301 is held by the spider 302 at rig floor. A pipe 303 is connected via a coupling 304 to pipe string 301. The clamp manipulator 50 includes a guide boom 305 pivotally attached to a base 306. In one embodiment, the guide boom 305 is similar to the guide booms 200, 500. For example, the guide boom 305 may use cylinders for pivoting about the base and the guide boom 305 may include telescopic features. In one embodiment, the base 306 may be coupled to a track for movement to and from the spider 302. A cable guide head 307 is pivotally connected at the guide boom 305 in order to guide the control line 300. The cable guide head 307 may be configured to receive the control line from the control line guiding system 5. As shown, the cable guide head 307 has an arcuate shape, which assists with maintaining a suitable curvature of the control line 300 during rotation of the cable guide head 307 or rotation of the guide boom 305. In one embodiment, the guide head 307 may be detached from the guide boom 305 while remaining engaged with the tubular string 301. This allows the tubular string 301 to be raised into the derrick after clamp installation while protecting and guiding the control line.

A clamp boom 309 is also pivotally attached to the base 306. The clamp boom 309 may use cylinders or gears for pivoting about the base and may include telescopic features. The clamp boom 309 may be equipped with a clamp gripping device 310.

Figure 20:
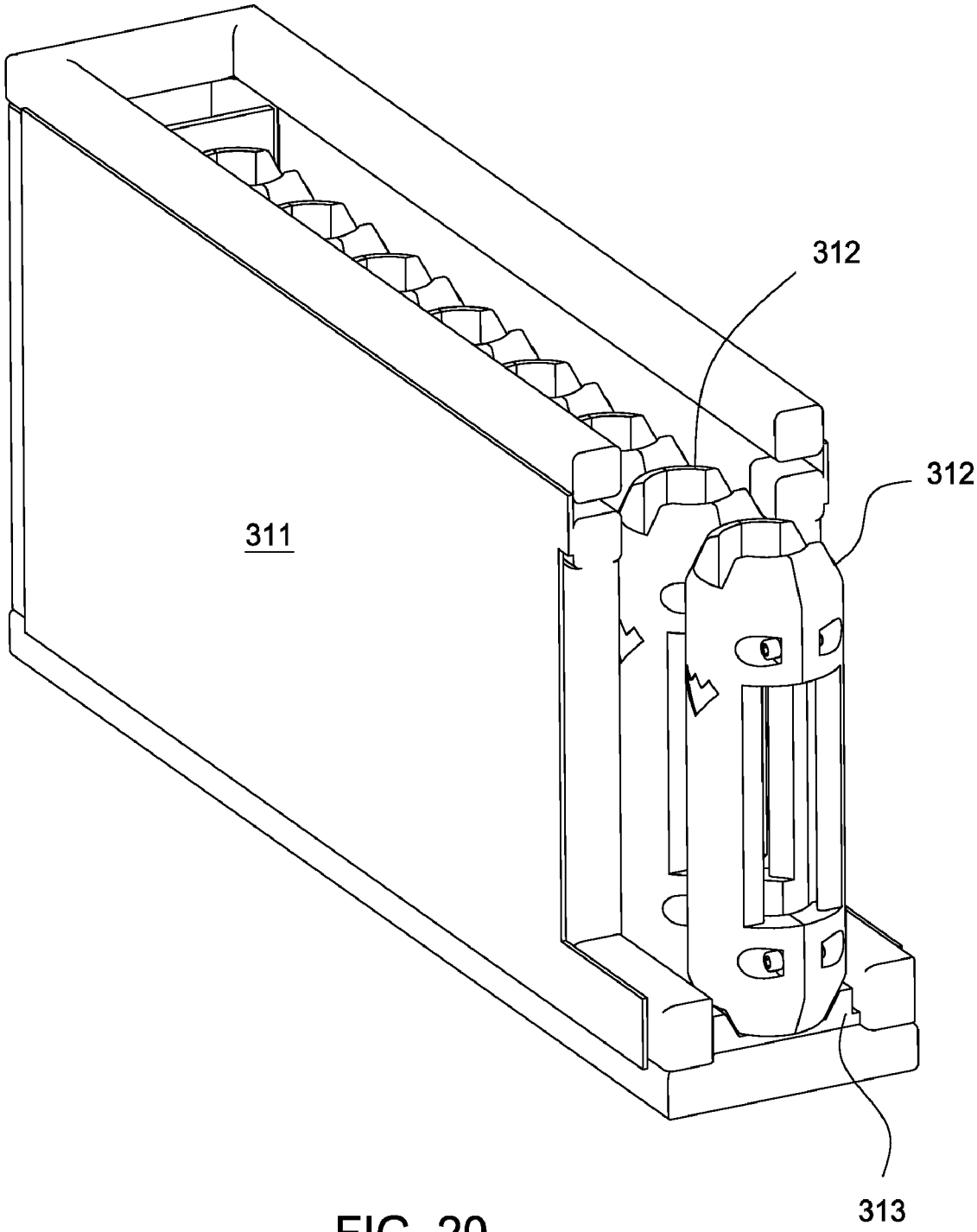
FIG. 20 shows an exemplary clamp magazine for storing a clamp.

FIG. 19 also shows a control line clamp magazine 311 is positioned on the rig. The clamp magazine 311 stores the clamps 312 until they are ready for installation to the tubular string. FIG. 20 shows an exemplary clamp magazine 311 for storing the clamps 312. The clamps 312 may be fed linearly by the clamp magazine 311 in order to position a clamp 312 at the transfer position 313 every cycle. A biasing member such as a spring may be used to linearly feed the clamps 312.

Figure 21:
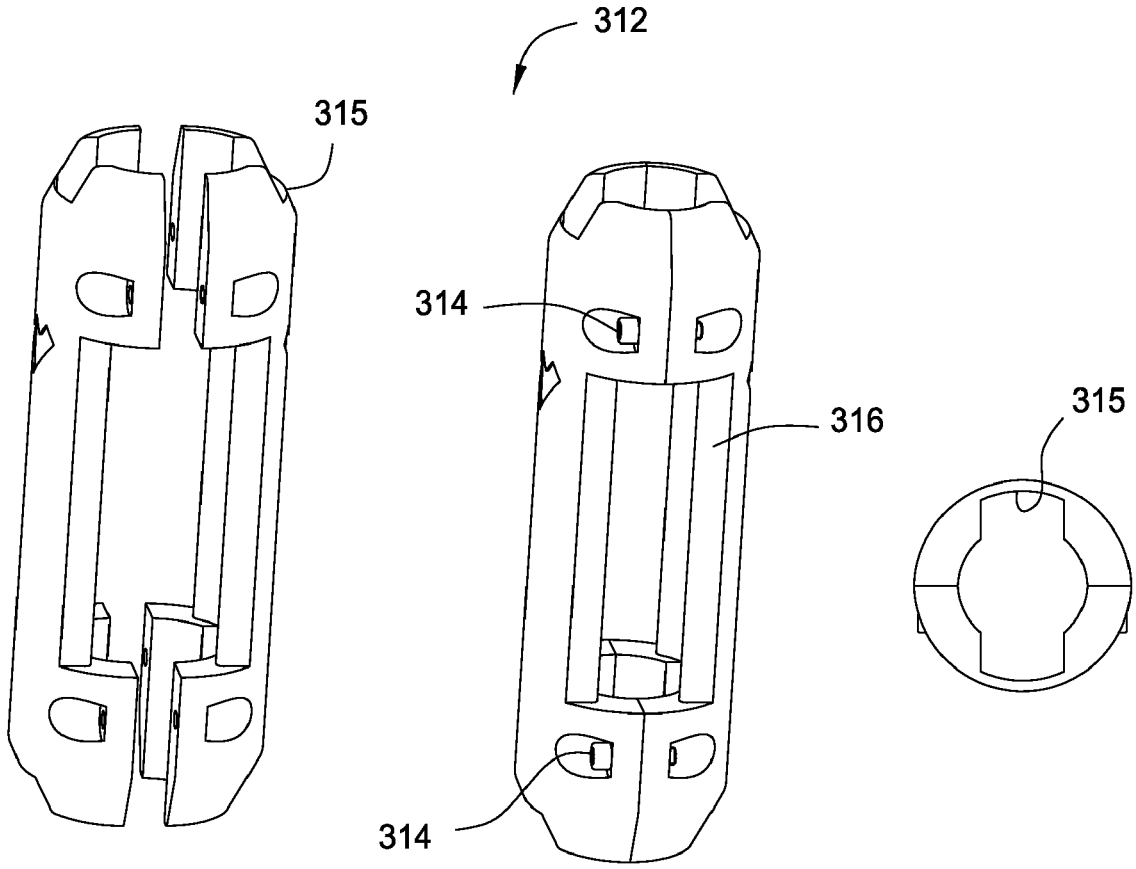
FIG. 21 shows an exemplary clamp suitable for installing the control line to the tubular string.

FIG. 21 shows an exemplary clamp 312 suitable for installing the control line to the tubular string. The clamp 312 may have two body parts that can be bolted together by screws 314 or other suitable fastener, such as latches, ratchets, rivets, etc. The fixing force of the clamp 312 at the tubular string around the control line depends on the dimensions of the clamp 312 and the make up torque of screws 314. When connected, the two body parts may define an internal bore to accommodate the tubular string and the control line 300. As shown, the bore may include one or more profiles 315 to accommodate the control line 300. The clamp 312 may also include one or more defined gripping areas 316 for handling by the clamp gripping device 310. In one embodiment, the gripping area 316 may be a recess profile formed on each body part. The recess profile provides shoulders for engagement with the clamp gripping device 310. In another embodiment, a conformable material may be disposed inside the clamp 312. For example, a layer of elastomer may be disposed on the interior surface of each body part. In use, when the clamp 312 or foam or other compressible material is positioned around the control line and the tubular string, the elastomer may conform to the outer surface of the control line and the tubular string. The conformed grip on the control line may prevent the control line from sliding around in the clamp 312. The conformable material may allow the clamp to be used with any number of lines and any combination of sizes and shapes of line. In another embodiment, the clamp 312 may include an "universal" clamp shell and a preformed insert. The insert may be preformed for use with various control line configurations. A variety of inserts may be used with a common universal clamp shell.

Figure 22:
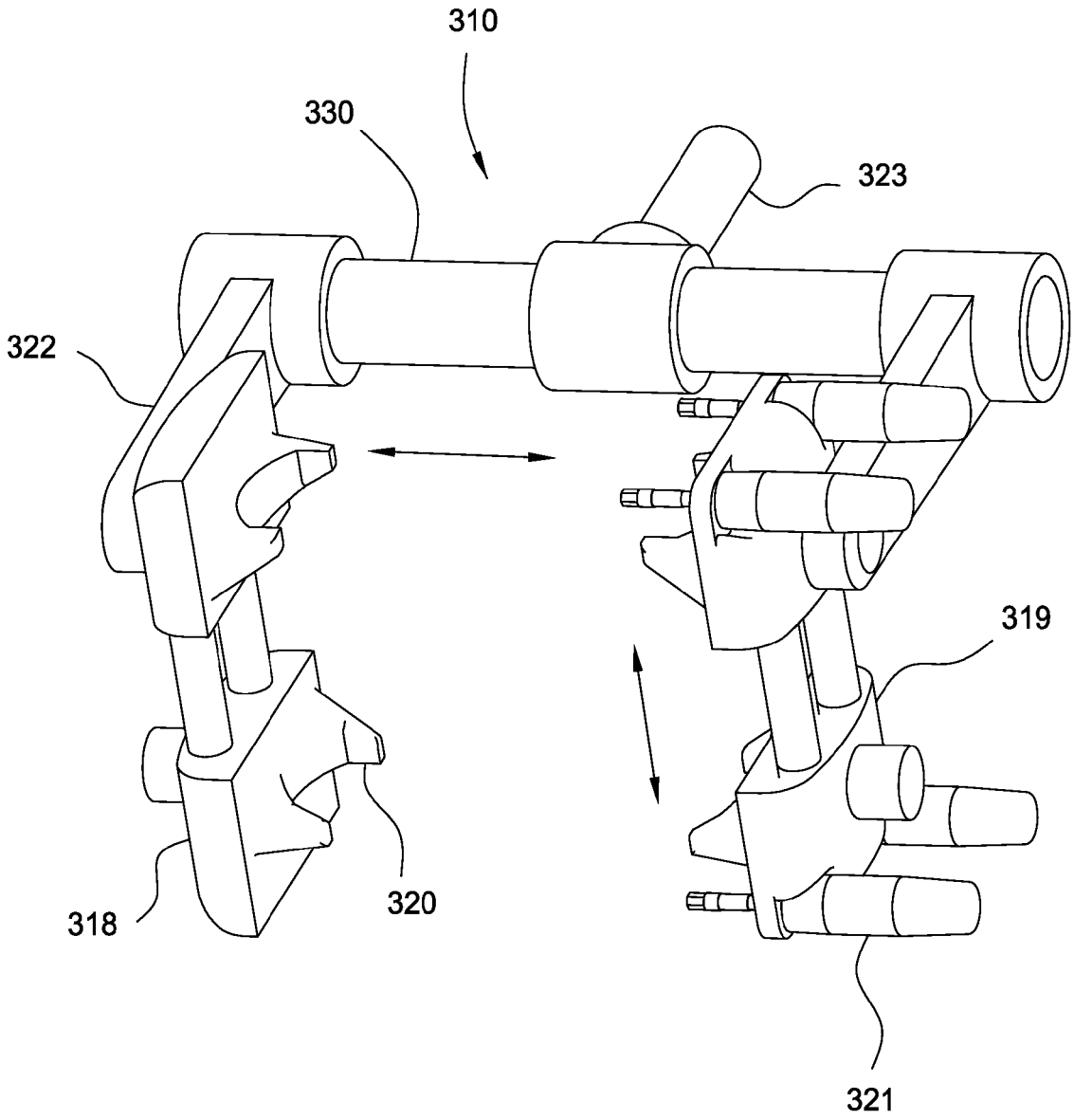
FIGS. 22 and 23 show an exemplary clamp gripping device for handling a clamp.
Figure 23:
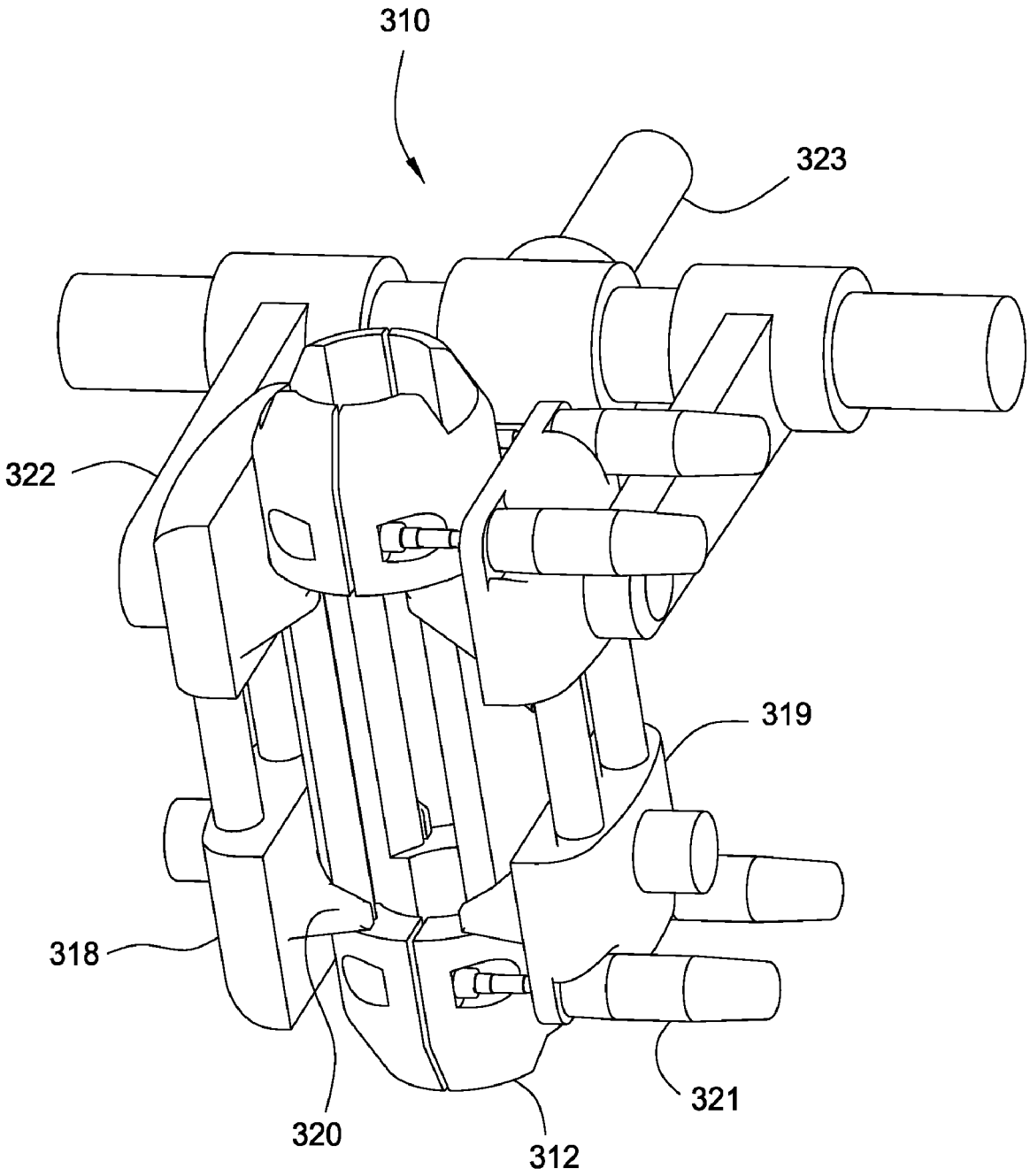

FIGS. 22 and 23 show an exemplary clamp gripping device 310 for handling the clamps 312. The device has a shaft 323 for attachment to the clamp boom 309. An arm support 330 is connected to the shaft 323 and has an arm 322 coupled to an end of the arm support 330. A second arm may be coupled to another end of the arm support. The arms 322 are movable along the arm support 330. A gripping element 318, 319 is attached to each arm 322 for gripping the clamp 312. Each gripping element 318, 319 has a set of upper fingers and lower fingers 320 for engaging the shoulders of the gripping area 316 of the clamp 312. FIG. 23 shows the gripping elements 318, 319 gripping a clamp 312. In one embodiment, the fingers 320 may be expanded against the gripping area 316 to provide the gripping force. In another embodiment, the gripping elements may apply a vacuum force to retain the clamp. In yet another embodiment, the gripping elements may use a magnetic, mechanical, or other suitable mechanisms to retain the clamp 312.

In one embodiment, at least one of the gripping elements 319 is equipped with motor driven screw drivers 321. While gripping the clamp 312, the motor screw drivers may engage the screws 314 of the clamp in order to tighten or release the screws 314. In one embodiment, the motor screw drivers 321 may be fitted with an Allen key for engagement with a hexagon socket of the screw 314.

FIGS. 24-31 show an exemplary sequence of operations for installing a clamp on the tubular string. Initially, a tubular 303 is made up to a coupling 304 of a tubular string 301 held by the spider 302 at rotary table. At this point, the slips of the spider 302 are in the closed position. The control line 300 is supported by the cable guide head 307 and ready for installation. The control line 300 is held out of the way of the slips. A clamp 312 in the magazine 311 is located in the transfer position 313 and ready for pick up by the clamp gripping device 310. The clamp gripping device 310 is opened and positioned adjacent the clamp 312 by the clamp boom 309.

Figure 24:
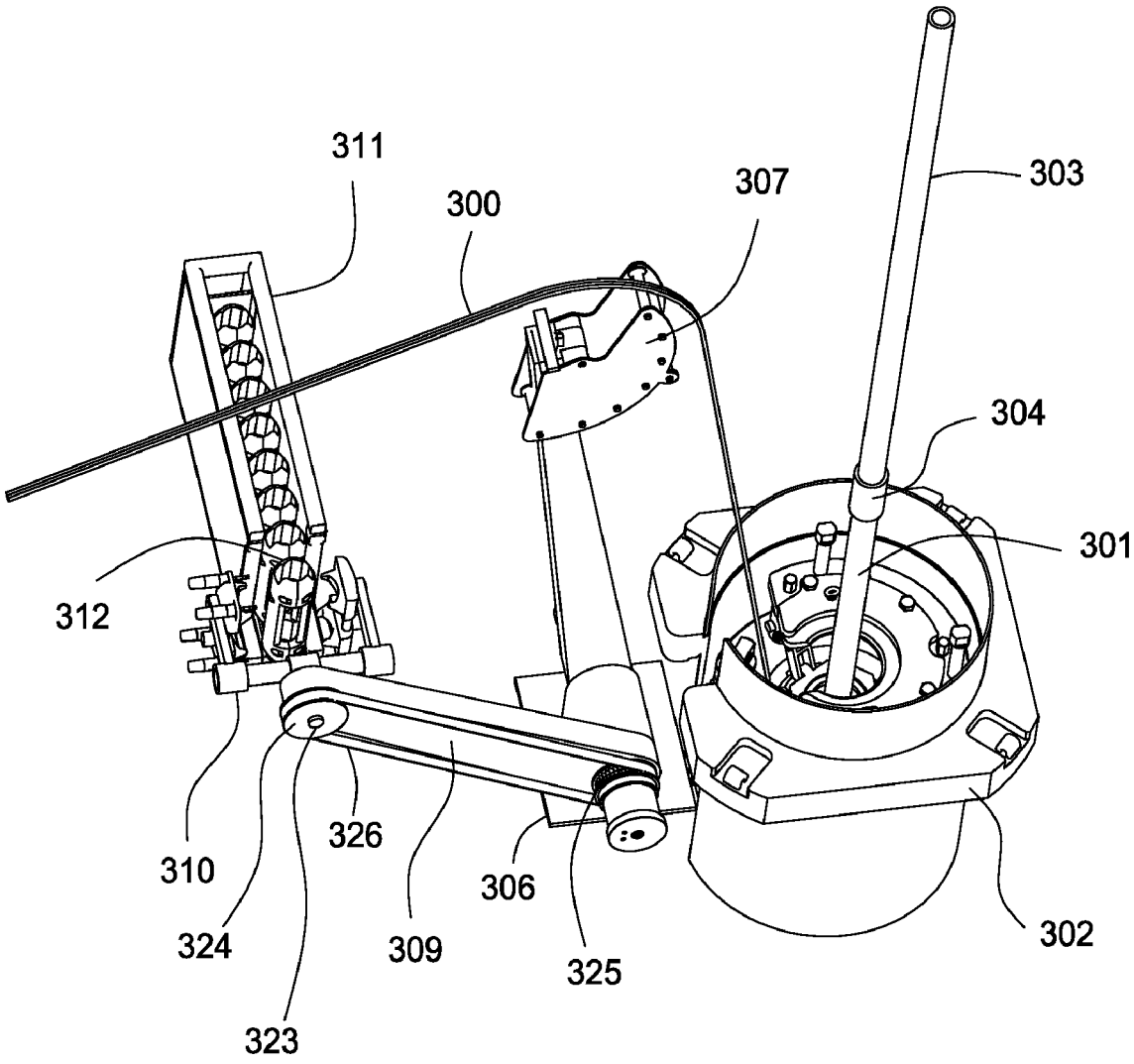
FIGS. 24-31 show an exemplary sequence of operations for installing a clamp on the tubular string.

In one embodiment, the clamp boom 309 includes a gear system for rotating the shaft 323 of the gripping device 310, as shown in FIG. 24. The gear system includes a first gear 324 connected to the shaft 323 and a second gear 325 coupled to the base 306. A belt 326 or chain is connected to both gears 324, 325. The gear system is configured to move the clamp 312 from the clamp magazine 311 to the well center while maintaining the clamp 312 substantially parallel to the axis of the tubular string 301.

Figure 25:
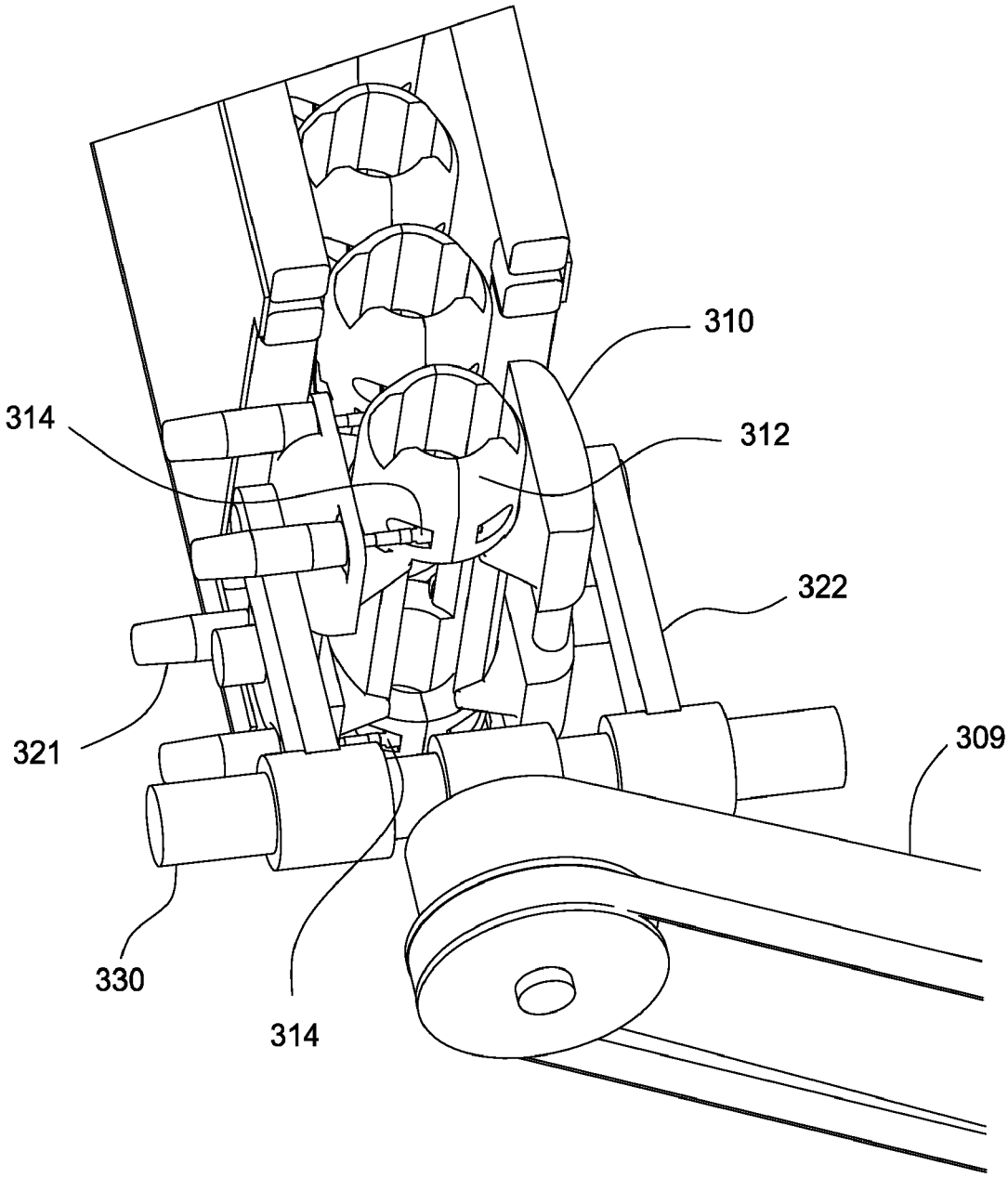

In FIG. 25, the arms 322 of the clamp gripping device 310 has moved relative to the support arm 330 and gripped the clamp 312 using its fingers 320. The motor screw drivers 321 are activated to engage and release the screws 314 of the clamp 312. As shown, the clamp gripping device 310 is in a position in which the clamp 312 is substantially parallel to an axis of the tubular string 301.

Figure 26:
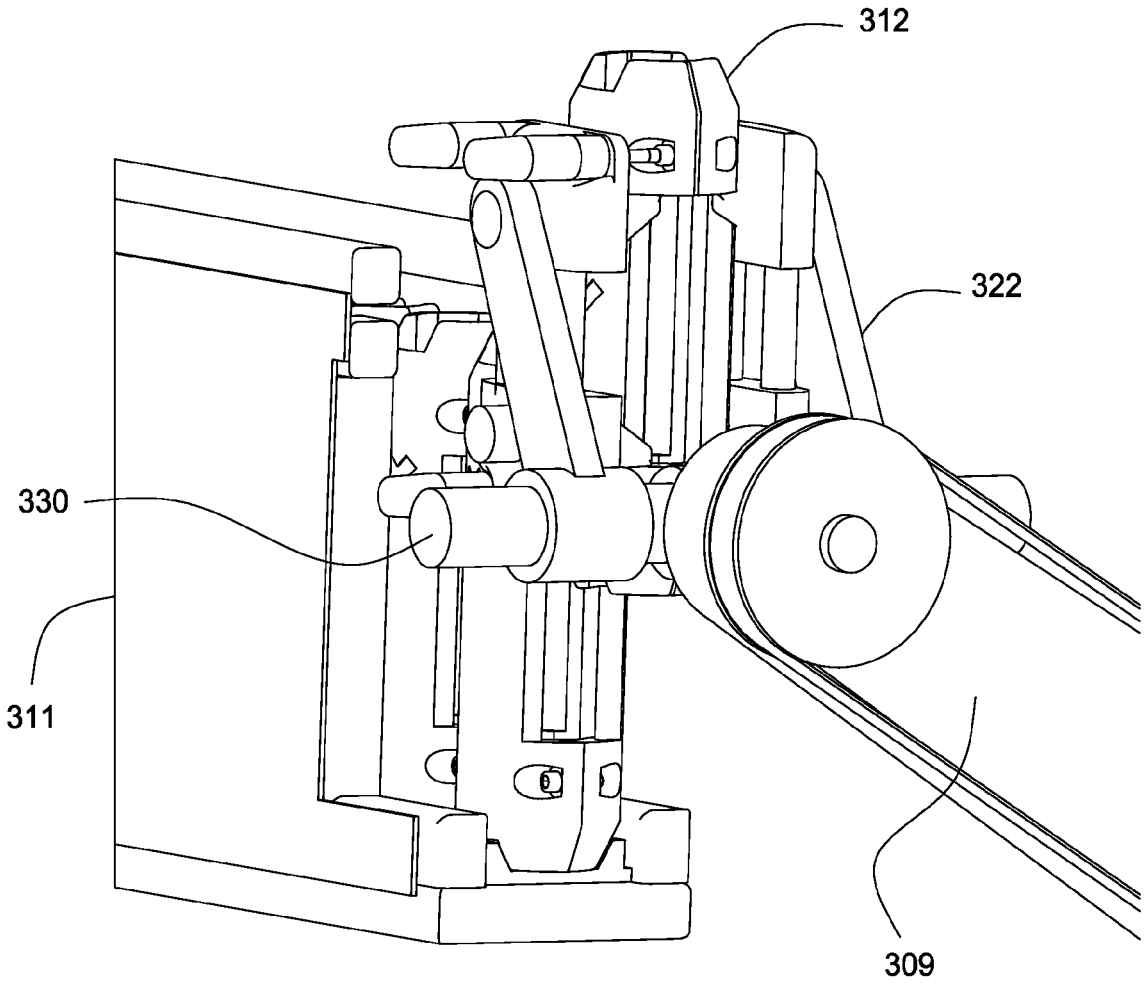
Figure 27:
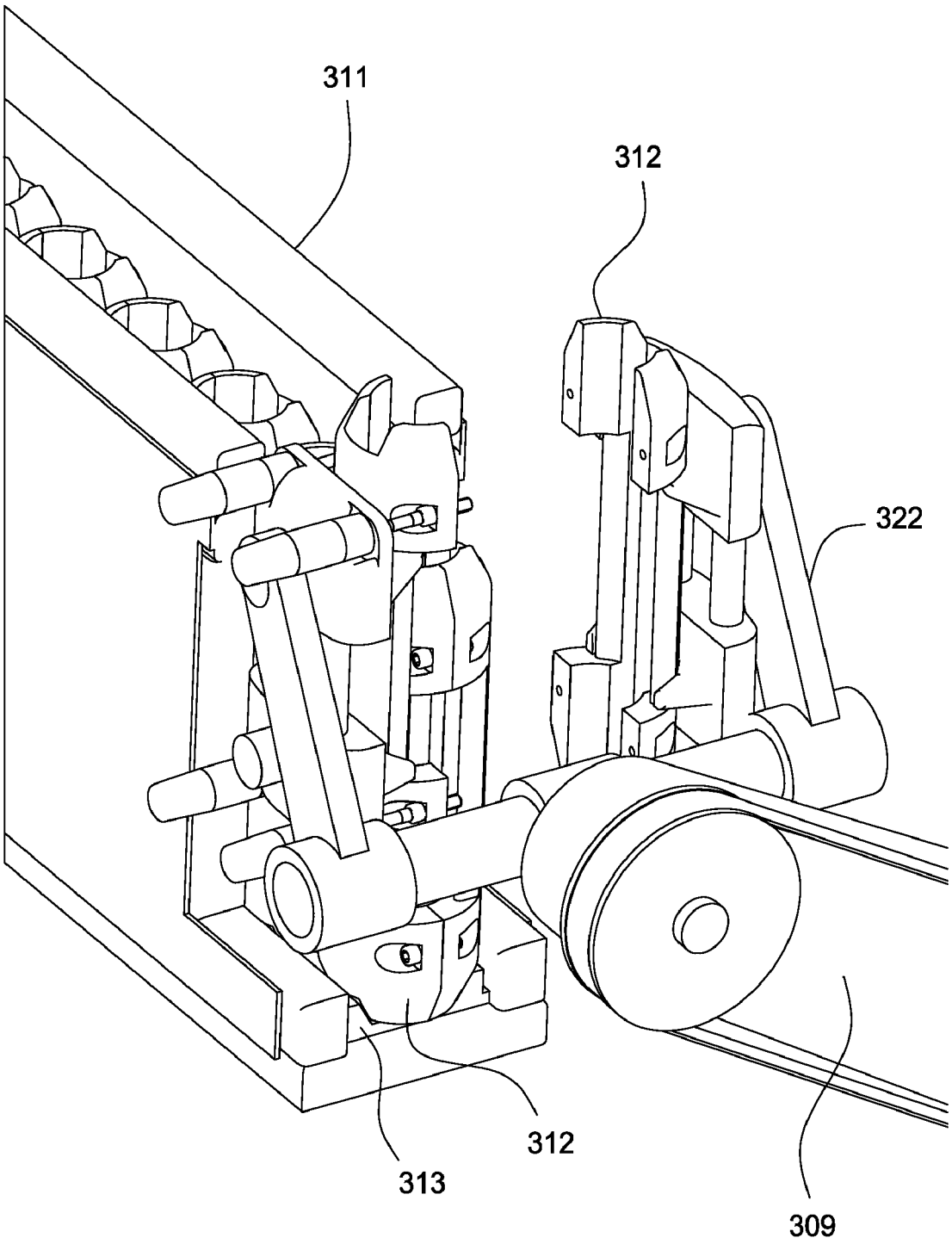

In FIG. 26, the arms 322 of the clamp gripping device 310 are rotated about the arm support 330 until the clamp 312 is lifted out of the clamp magazine 311. Because the arms 322 are rotated about the arm support 330, the alignment of the clamp 312 with the tubular string 301 is maintained. It can also be seen that the clamp magazine 311 has moved the next clamp to the transfer position 313. In FIG. 27, clamp gripping device 310 is opened by retracting the arms 322 to separate the two body parts of the clamp 312.

Figure 28:
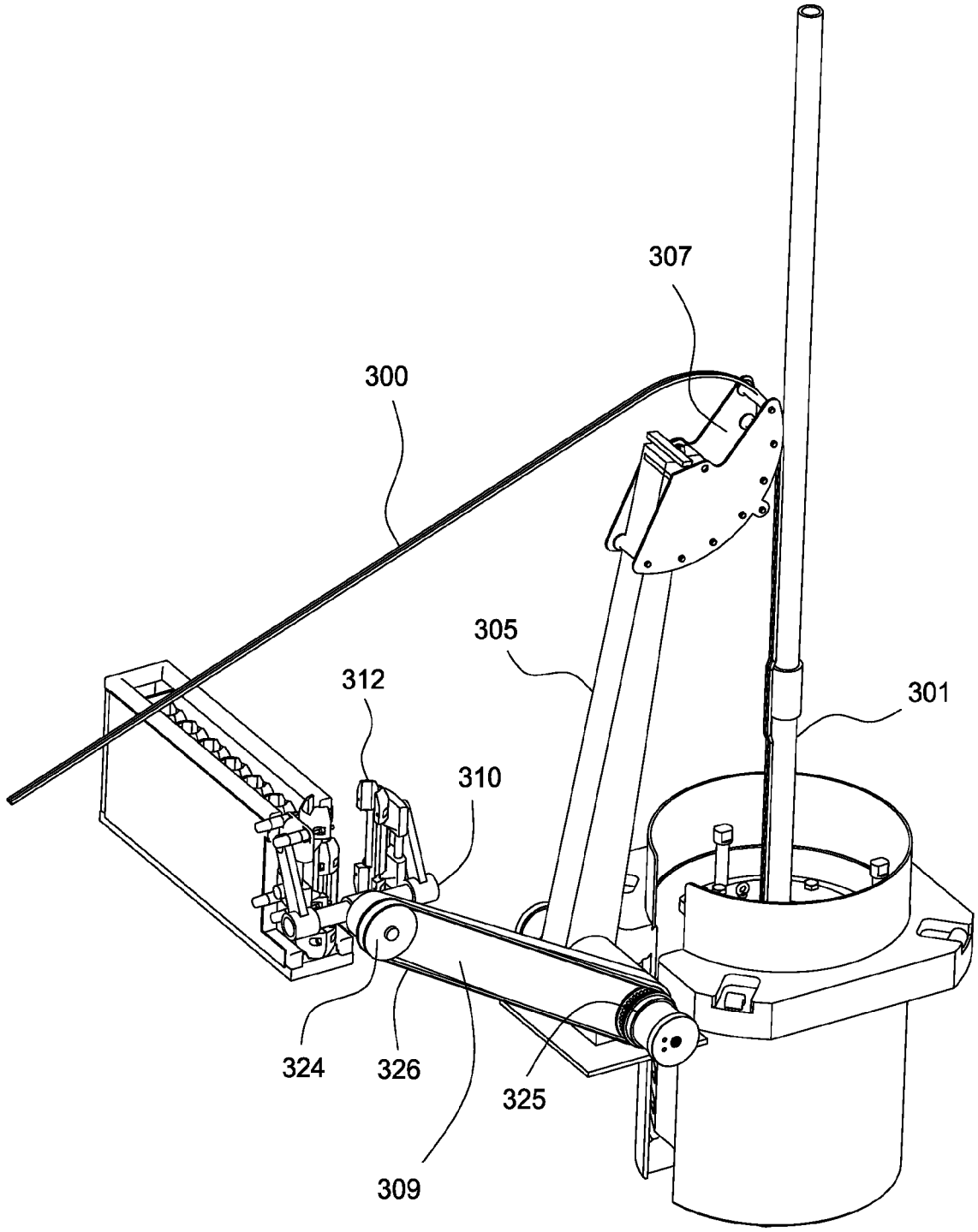
Figure 29:
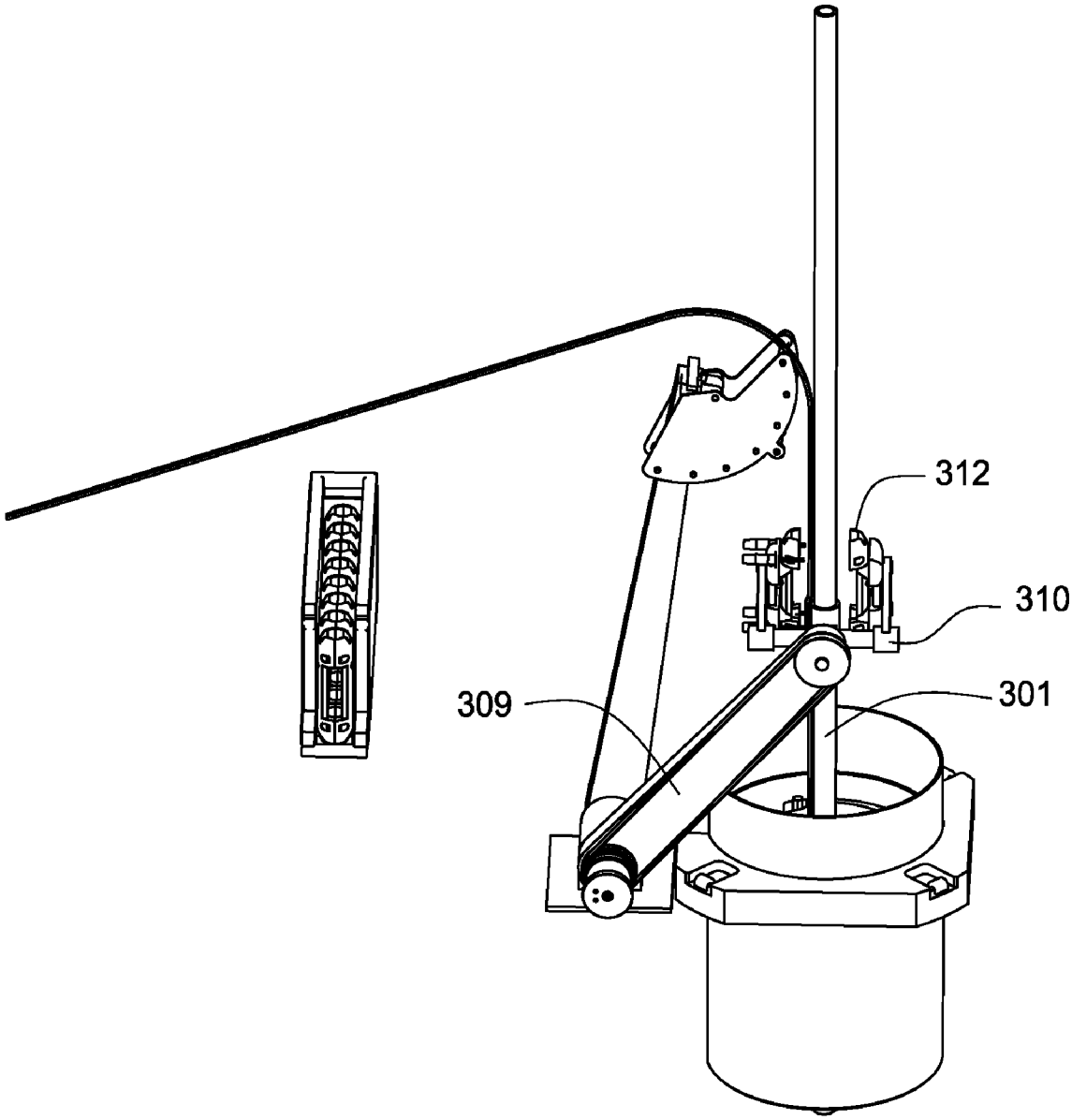
Figure 30:
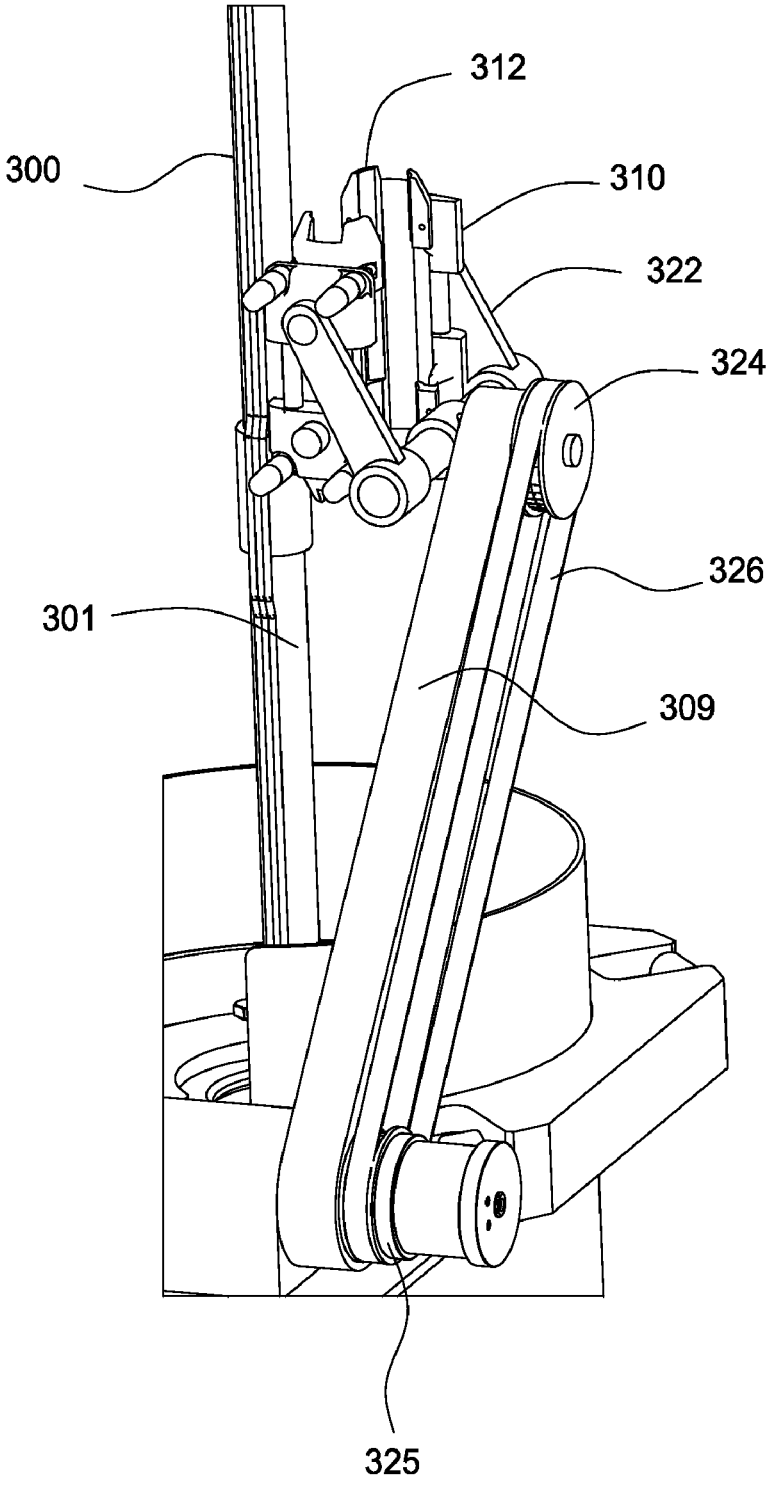

In FIG. 28, the guide boom 305 and cable guide head 307 are rotated toward the tubular string 301 until the control line 300 is adjacent to the tubular string 301. It should be noted that the slips of the spider are usually opened before the control line is moved toward the tubular string. Then, the clamp boom 309 rotates about the base 306 until the clamp gripping device 310 and the clamp 312 are positioned at string center, as shown in FIG. 29. During rotation of the clamp boom 319, the gears 324, 325 are rotated to maintain the clamp 312 in a position parallel to the axis of the tubular string 301. FIG. 30 shows another view of the clamp 312 positioned at string center. It can be seen that the clamp 312 is substantially parallel to the tubular string 301 and the arms 322 are in the raised position.

Figure 31:
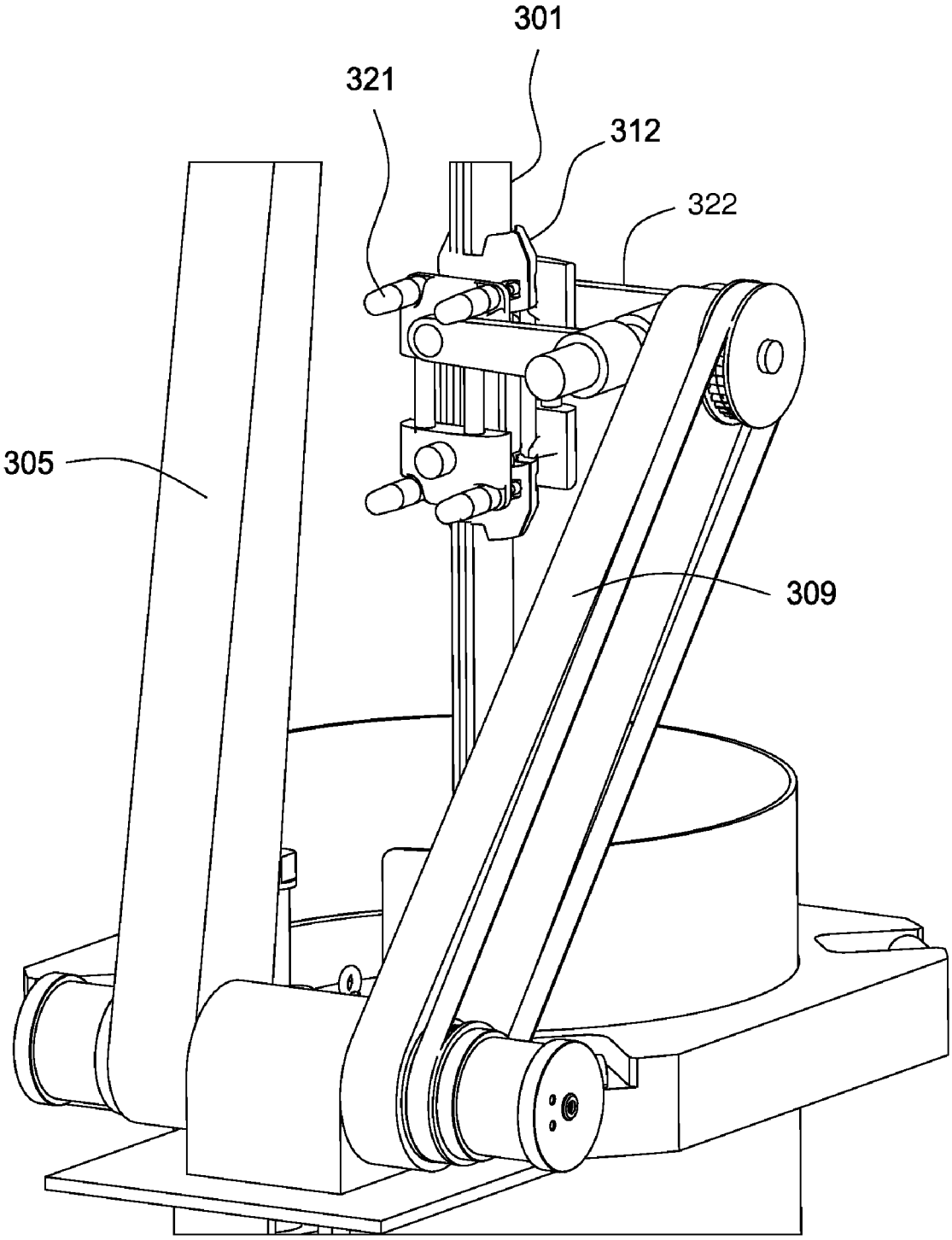

In FIG. 31, the arms 322 of the clamp gripping device 310 have rotated to a substantially horizontal position, whereby the clamp 312 has straddled the coupling. The arms 322 have moved toward the tubular string 301, thereby pressing the two body parts of the clamp 312 against the tubular string 301. The motor driven screw drivers 321 are then powered to tighten the screws 314 until clamp 312 is attached to the tubular string 301. For embodiments in which the clamp is fastened by other mechanisms (such as latches, ratchets, and rivets), the screw driver 321 may be substituted by any suitable device to ensure the clamp secured to the tubular.

Thereafter, the arms 322 are moved away from the tubular string 301 until the clamp gripping device 310 is retracted from the tubular string 301. The guide boom 305 and the clamp boom 309 may now be moved back to the start position shown in FIG. 24.

In one embodiment, the clamp gripping device may include a sensor for ensuring proper installation of the clamp. For example, a sensor may be positioned on the screw driver to determine the number of rotations performed by the screw driver. In another example, clamp gripping device may exert a mechanical force such as push or pull to determine rigidity of the installed clamp before release. In yet another example, a camera may be installed to view the clamping process.

Spider

Figure 32C:
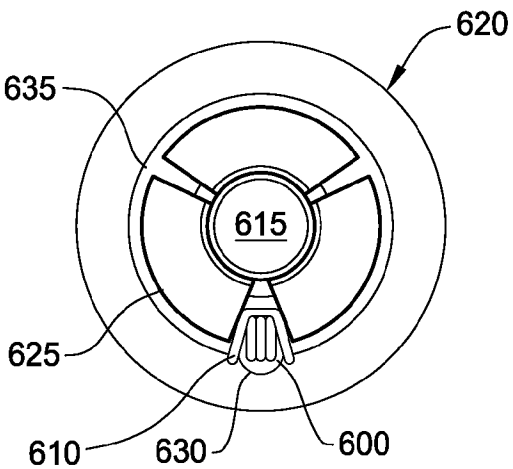
FIGS. 32A-C illustrate a protection tool used to prevent damage to a control line.
Figure 32B:
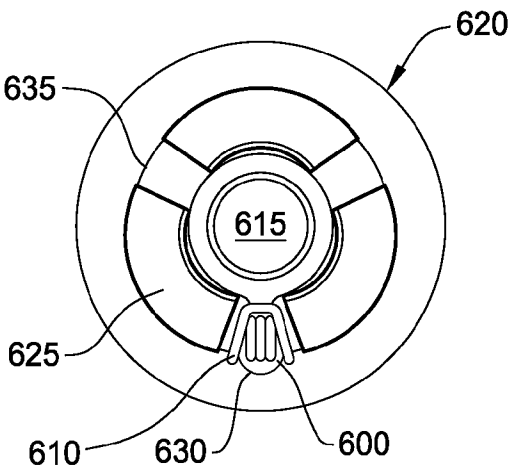
Figure 32A:
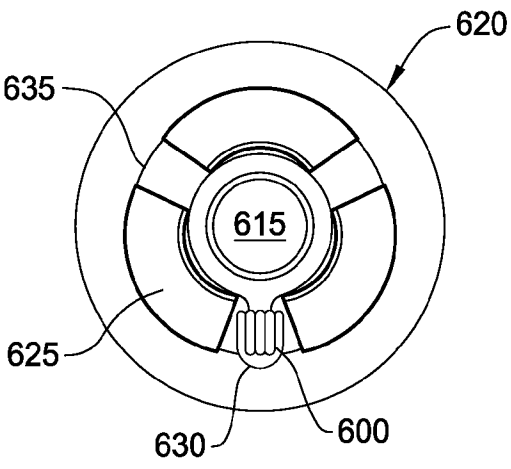

In another embodiment, apparatus and methods are provided to prevent accidental closure of the slips around the control line. FIGS. 32A-C show a protection tool 610 in use with a spider 620 to maintain the control line 600 away from the tubular string 615. Referring now to FIG. 32A, the spider 620 is shown with the slips 625 in the open position. The control line 600 has been pulled away from the tubular string 615 and positioned in a safe area 630 such as a groove in the body 635 of the spider 600. Before the slips 625 are closed, the protection tool 610 is disposed around the control line 600 as shown in FIG. 32B. Exemplary protection tools include a barrier such as a plate, a sleeve, a chute, a line, or any tool capable of retaining the control line in the safe area while closing the slips. In one embodiment, the protection tool may be a gate controlled by a controller. The gate may include one door or two doors which can be closed to maintain the control line in the safe area 630. The two doors embodiment may be arranged to bisect the path of the control line, thereby allowing more clearance for the movement of the slips. FIG. 32C shows the slips 625 closed around the tubular string 615. It can be seen in FIG. 32C that the protection tool 610 prevents the control line 600 from being damaged by the slips 625. It is contemplated that the control line may be moved manually by an operator, the control line positioning device described herein, or any suitable control line positioning device. In another embodiment, the spider may include three slips, wherein one of the slips is located on a door of the spider and the safe area for the control line is located opposite the door and between the other two slips. This arrangement provides protection for the control line by requiring movement "away" from the control line during removal of the spider while the tubular string is present.

Figure 33C:
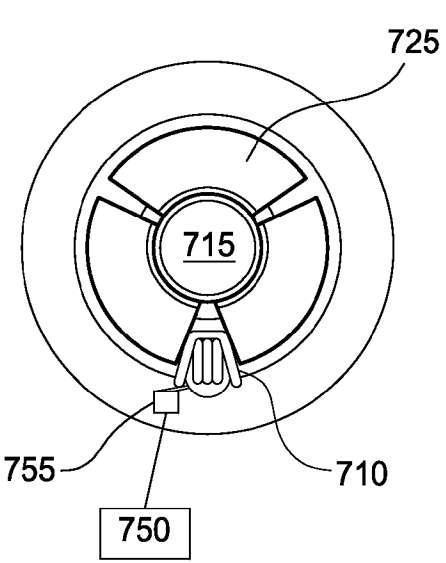
FIG. 33A-C illustrate a safety interlock system used to prevent damage to a control line.
Figure 33B:
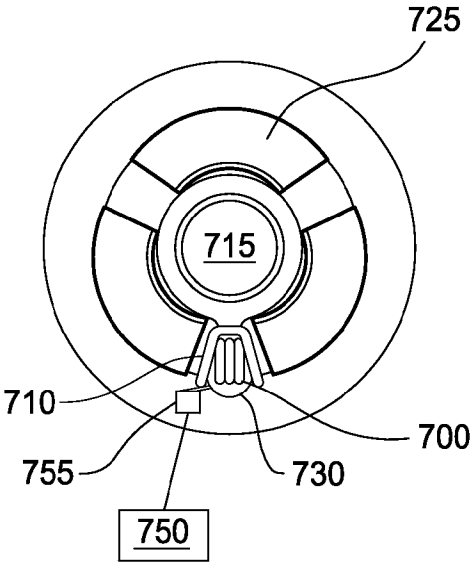
Figure 33A:
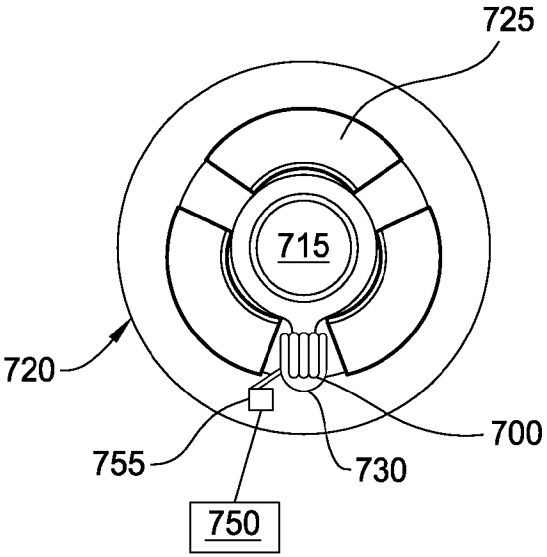

In another embodiment, a safety interlock system may be used to prevent control line damage, as shown in FIGS. 33A-C. Referring to FIG. 33A, the spider 720 is shown with the slips 725 in the open position and is provided with an interlock system having a safety interlock trigger 755 and an interlock controller 750. The safety interlock trigger 755 is adapted to send one or more signals to the interlock controller 750 to control the movement of the slips 725. As shown, the safety interlock trigger 750 is initially in the unactuated position and is adapted to be actuated by the protection tool 710. The interlock controller 750 prevents the slips 725 from closing until the safety interlock trigger 755 is actuated by the protection tool 710. In one embodiment, the safety interlock trigger 755 comprises an interlock valve which can be operated by the presence of the protection tool 710. In another embodiment, the safety interlock trigger 755 comprises a sensor when can detect the presence of the protection tool 710. The sensor may be selected from an electrical sensor, optical sensor, and any suitable sensor for detecting the presence of the protection tool. It is contemplated that the safety interlock trigger may comprise any suitable device capable of determining that the control line is protected by the protection tool 710.

In FIG. 33B, the protection tool 710 has been installed to retain the control lines 700 in the safe area 730. As shown, the protection tool 710 physically engages the interlock trigger 755, thereby causing the interlock trigger 755 to send a signal to the interlock controller 750 indicating that the control line 700 is protected. In turn, the interlock controller 750 may allow the slips 725 to safely close around the tubular string 715. Because the slips 725 cannot close until the protection tool 710 is installed, the slips 725 are prevented from accidentally closing on the control line 700. In yet another embodiment, if the protection tool 710 has a controller, the controller may be connected to the interlock controller 750. In this respect, the protection tool controller may send information regarding the status of the control line 710 to the interlock controller 750, thereby preventing accidental closing of the slips. For example, the protection tool controller may signal that the protection tool 710 such as a gate is open. The signal, in turn, will cause the interlock controller 750 to prevent the slips from being closed. FIG. 33C shows the slips 725 in the closed position and the control line 700 cleared from potential damage by the slips 725. When the slips 725 are open again, the protection tool 710 is removed to allow the pusher arm (or any control line manipulating apparatus) to move the control line 700 toward the tubular string 725 for clamping therewith. It is contemplated that the protection tool and/or the safety interlock may be used in conjunction with the pusher device to facilitate the installation of the control line and to prevent damage to the control line. It is further contemplated that the protection tool and/or safety interlock may be used with manual installation of the control line. It is further contemplated that the protection tool and/or the safety interlock are usable with any tubular gripping device having one or more slips and is adapted for running tubulars.

In another embodiment, the spider is provided with sensing mechanism, such as a spring loaded roller assembly or sleeve that is adapted to engage the control line in the retracted position. When the control line is retracted in the safe area, the control line is pushed against the sensing mechanism (roller assembly). In turn, the sensing mechanism (roller assembly) activates an interlock valve adapted to only allow closing of the slips when the sensing mechanism (roller) is fully pushed back or otherwise engaged by the control line.

In another embodiment, the spider may be provided with a manually activated interlock switch. The interlock switch must be manually activated by a control line operator before the slips can be closed.

In another embodiment, a retaining member is used to secure the control line in a safe area inside the spider when it is desired to close the slips. The retaining member activates the interlock valve or sensor when it is safe to close the slips, thereby preventing accidental closing of the slips when the control lines are exposed for potential damage.

Control Line Running Operation

FIGS. 1-14 show an exemplary control line running operation. In FIG. 1, the elevation guiding device 7 is positioned at a lower end of the guide rail 8. A control line 300 has been unspooled from the cartridge 3 and positioned in a channel of the elevation guiding device 7. In FIG. 2, the elevation guiding device has been raised along the rail 8, thereby lifting the control line 300 above the rig floor.

Figure 4:
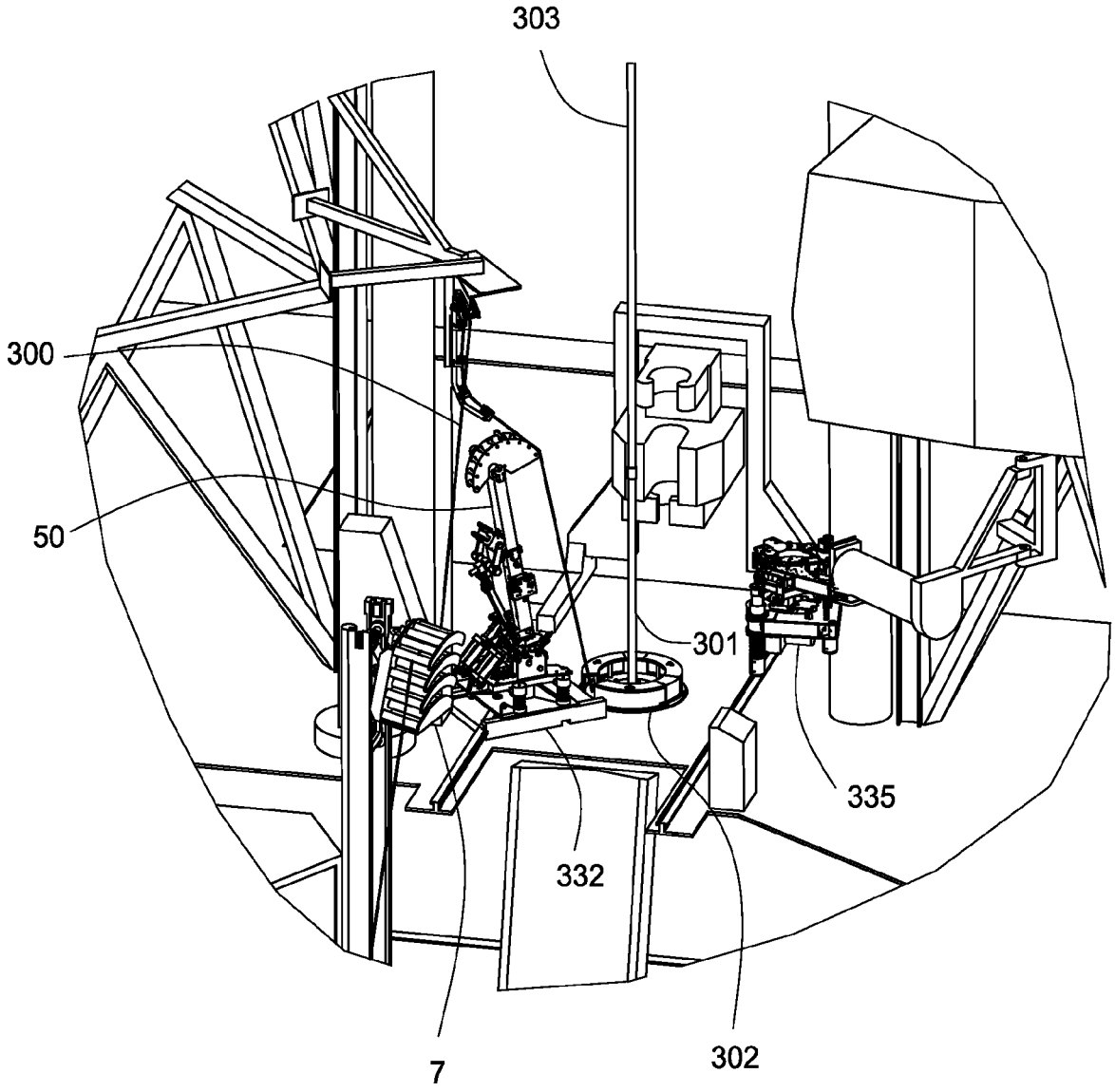
Figure 5:
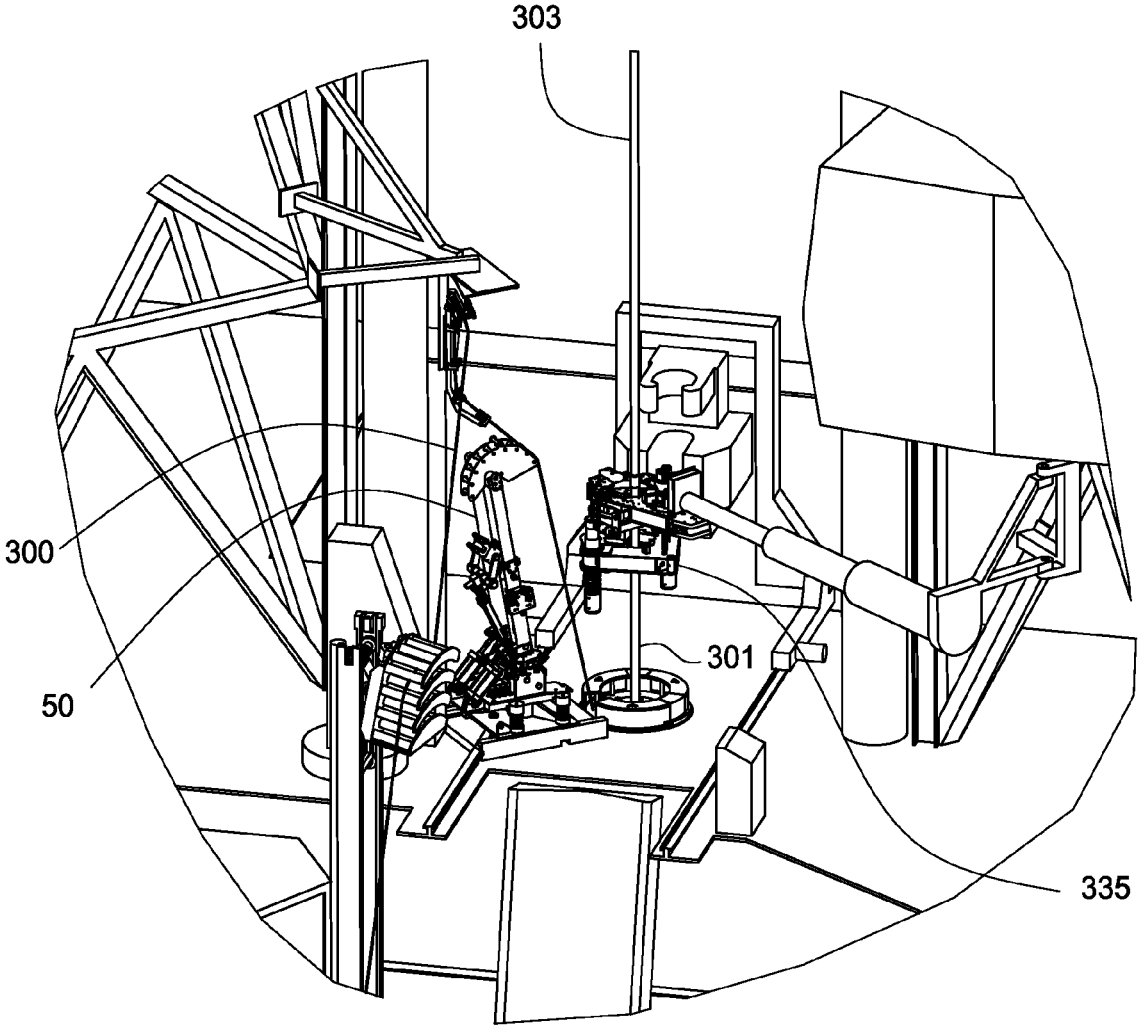
Figure 6:
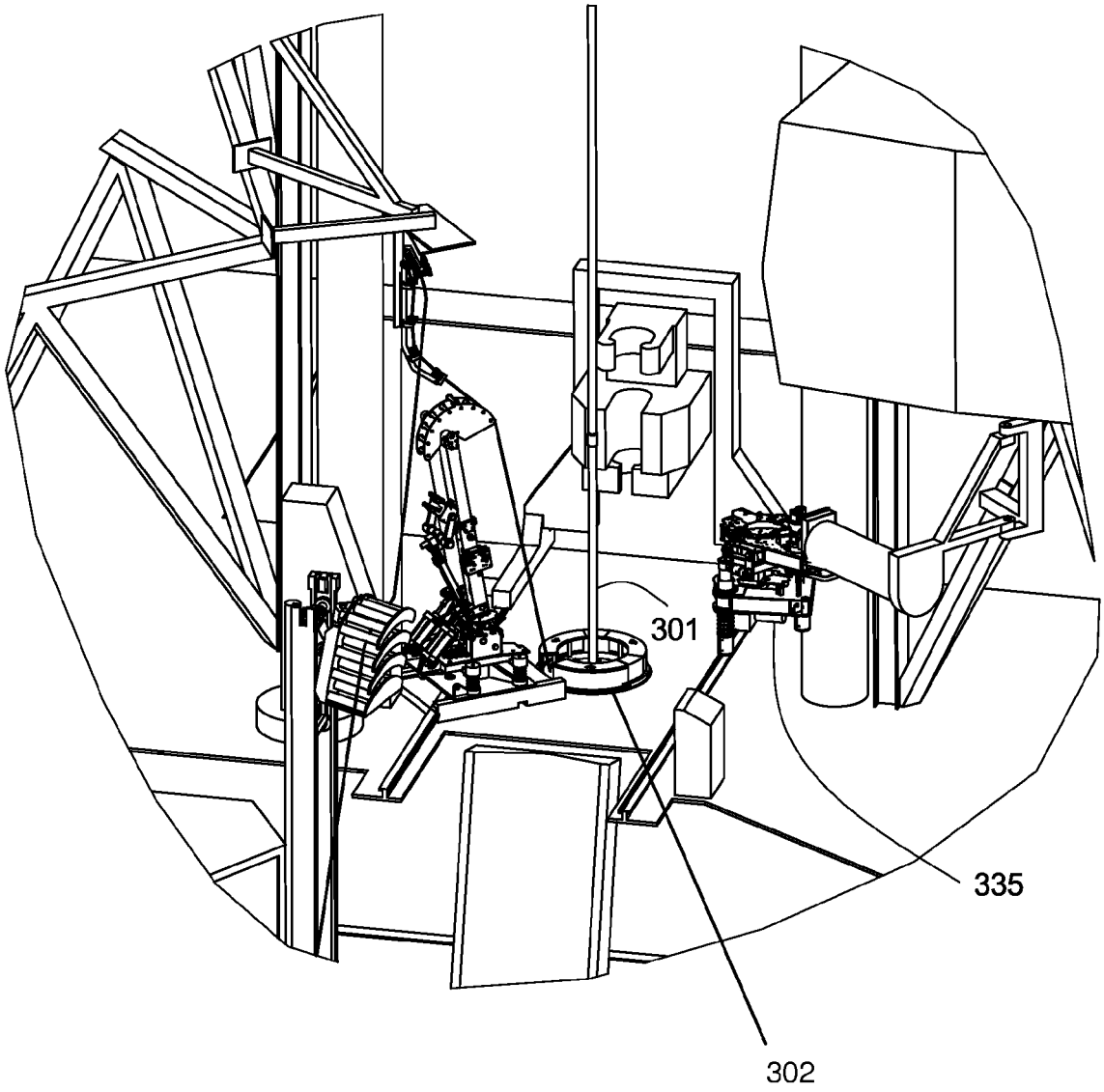

In FIG. 3, the control line 300 has been routed through the directional guiding device 10 and directed toward the manipulator assembly 50. The control line is engaged with the manipulator assembly 50 and extends into the well. At this point of the operation, the control line is maintained away from the tubular string. Also shown is a tubular string 301 held by a spider in the well and a tubular section 303 (held by the elevator 340 in FIG. 11) positioned above the tubular string 301. In FIG. 4, the tubular section 303 has been stabbed into the tubular string 301. A tong 335 is used to makeup the tubular connection as shown in FIG. 5. After completing the connection, the tong 335 is moved away from the well center as shown in FIG. 6. The tubular string 301 is now supported the elevator and the spider 302 is opened.

Figure 7:
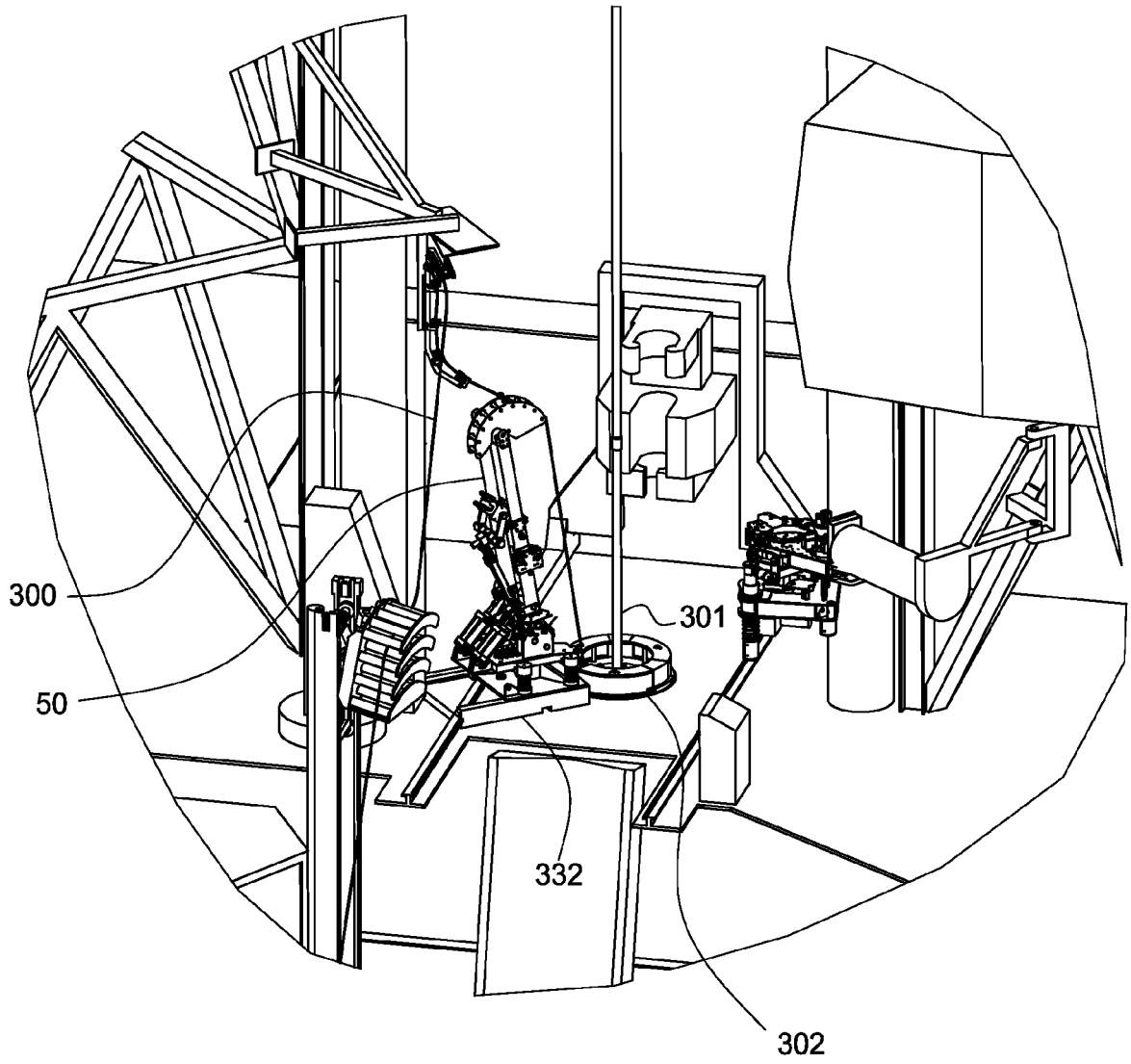
Figure 8:
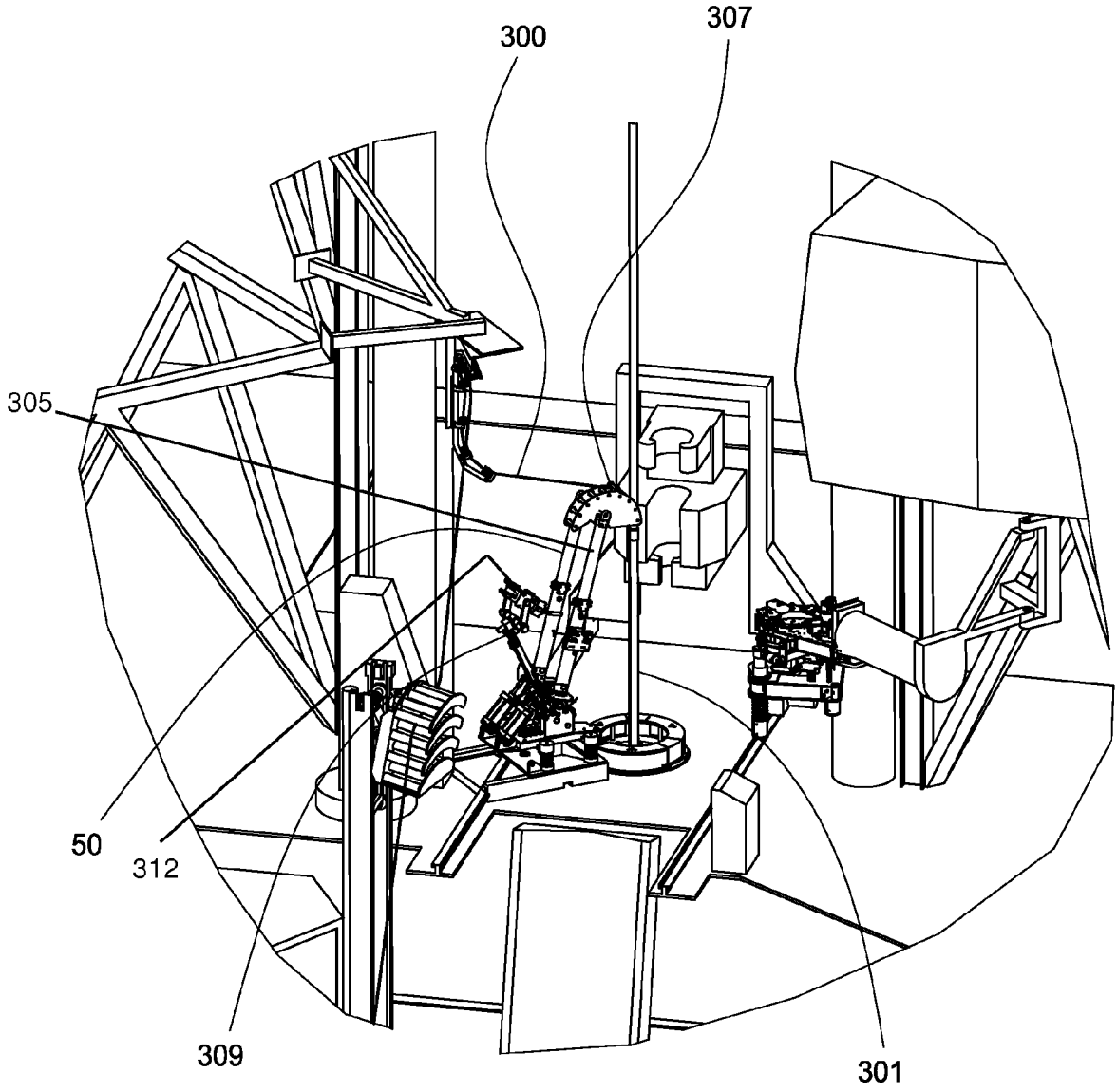

In FIG. 7, the manipulator assembly 50 is advanced on a track 332 toward the well center. A control line door in the spider 302 opens to allow the control line 300 to move toward the tubular string 301. In FIG. 8, the guide boom 305 and the guide head 307 of the manipulator assembly 50 has pivoted to move the control line 300 toward the tubular string 301. In one embodiment, the guide head 307 may move independently of the guide boom. As shown, the clamp boom 309 has already picked up a control line clamp 312.

Figure 9:
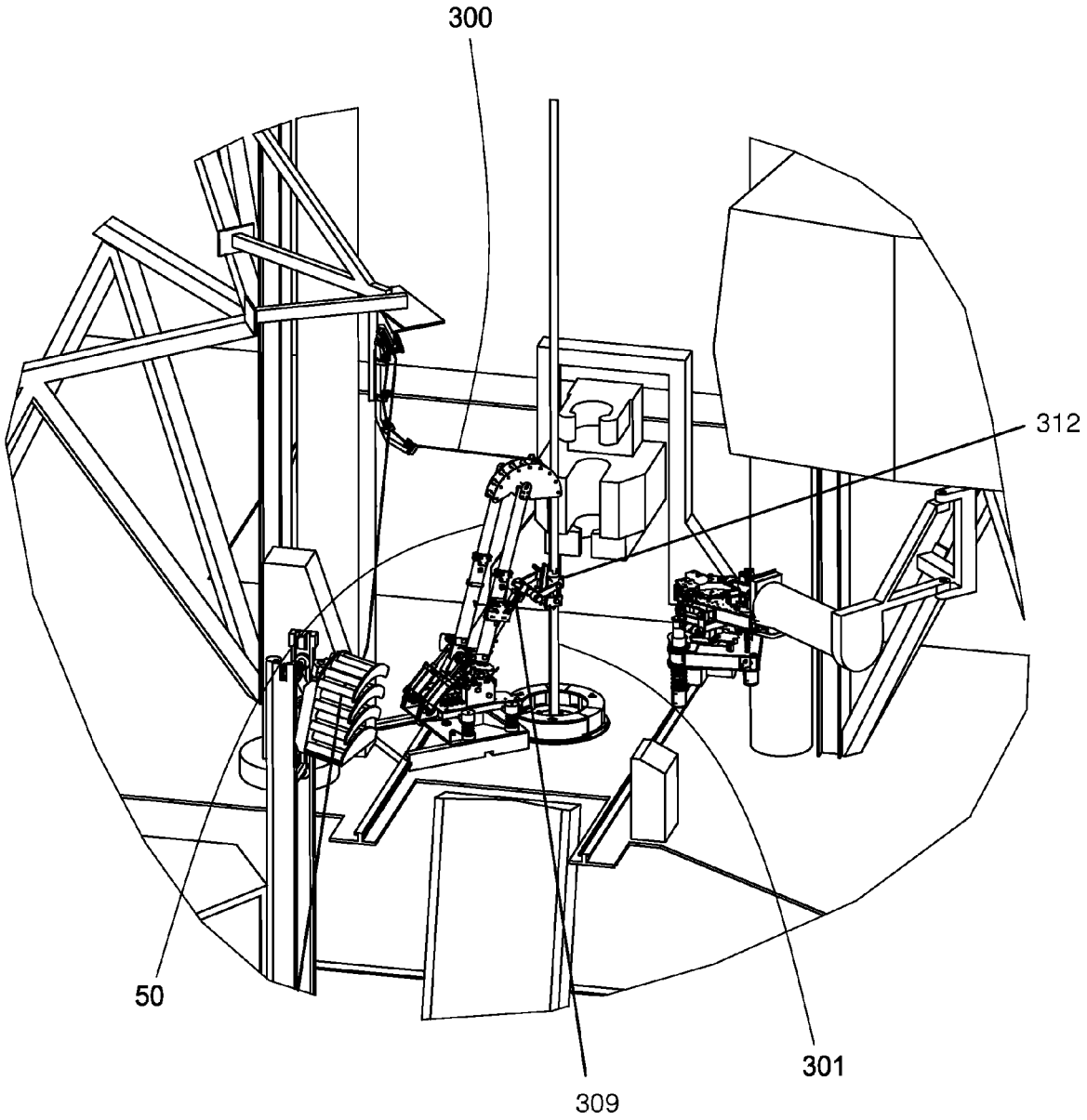
Figure 10:
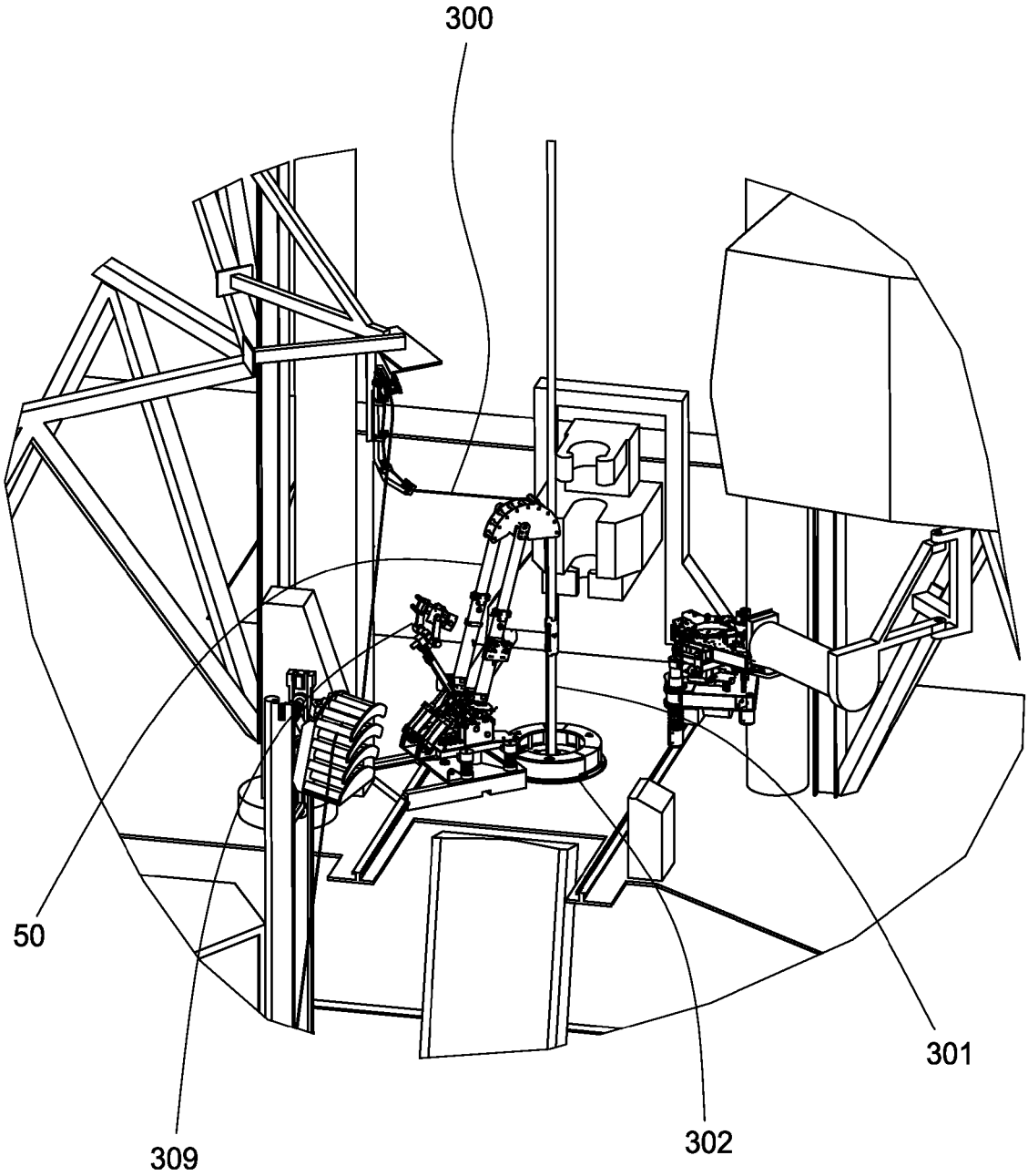

In FIG. 9, the clamp boom 309 has moved toward the control line 300 and the tubular string 301. The clamp 312 is installed around the control line 300 and the tubular string 301. Thereafter, the clamp boom 309 disengages from the clamp 312. In FIG. 10, the clamp boom 309 is retracted from the well center.

Figure 11:
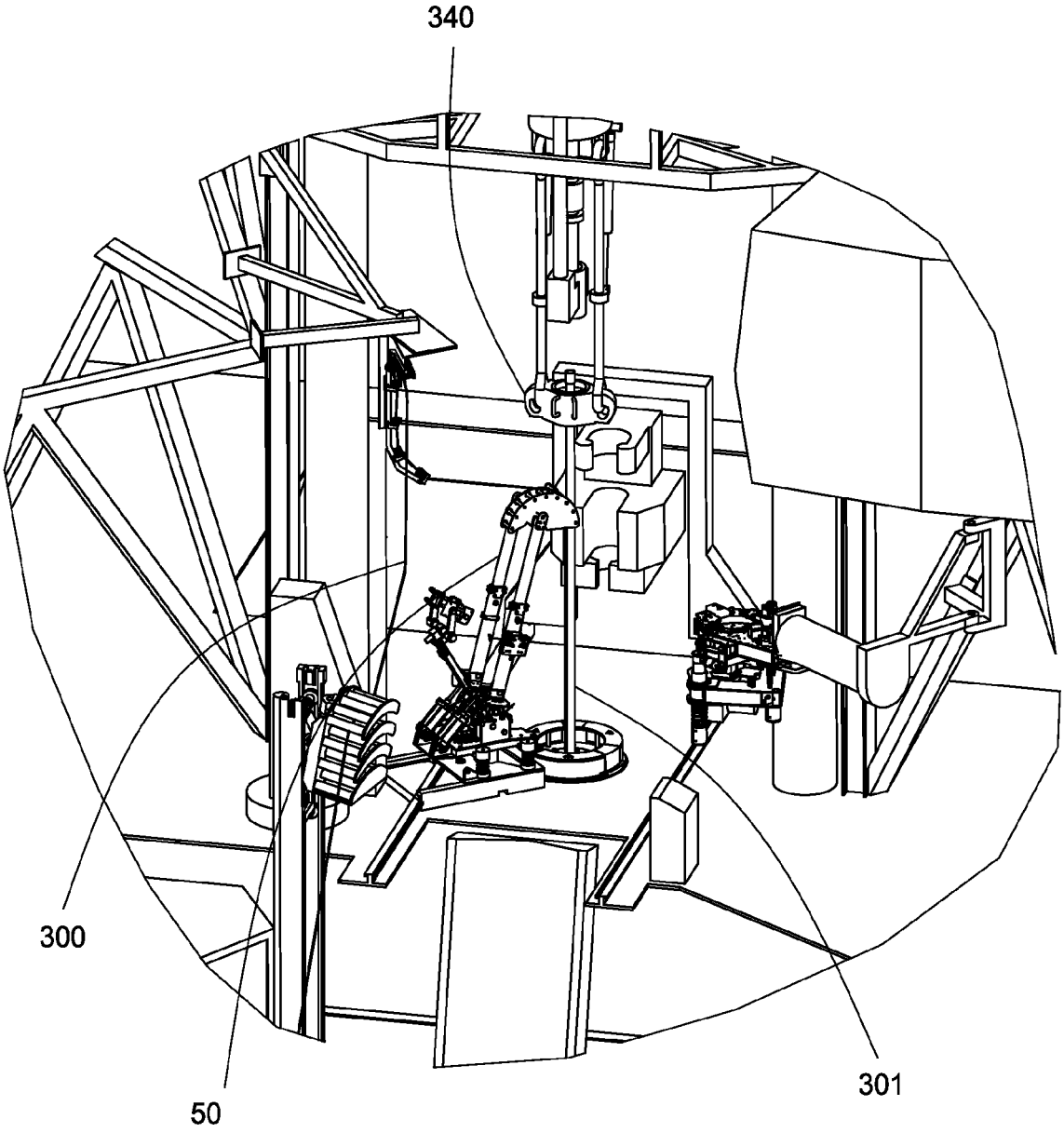
Figure 12:
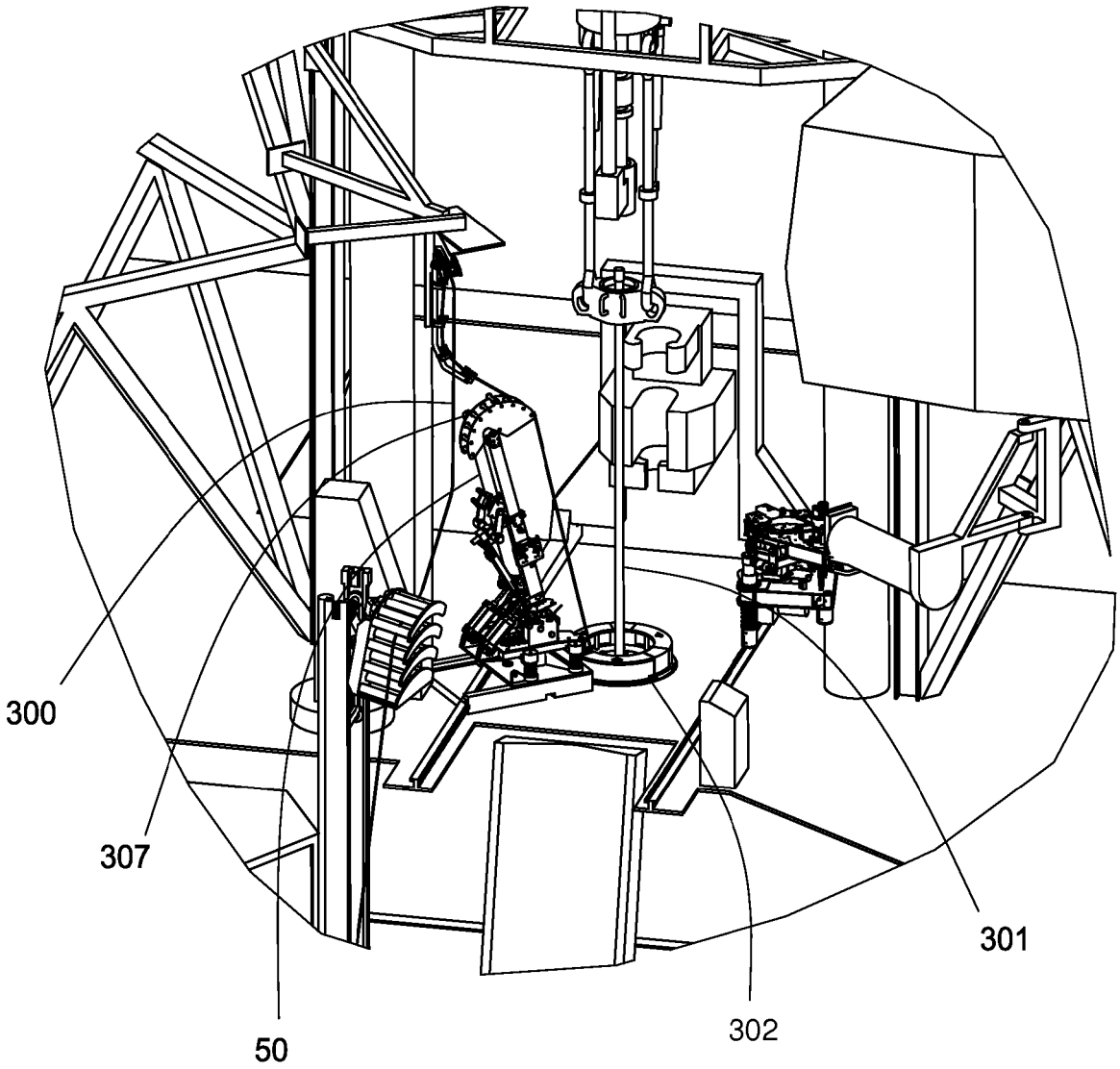
Figure 13:
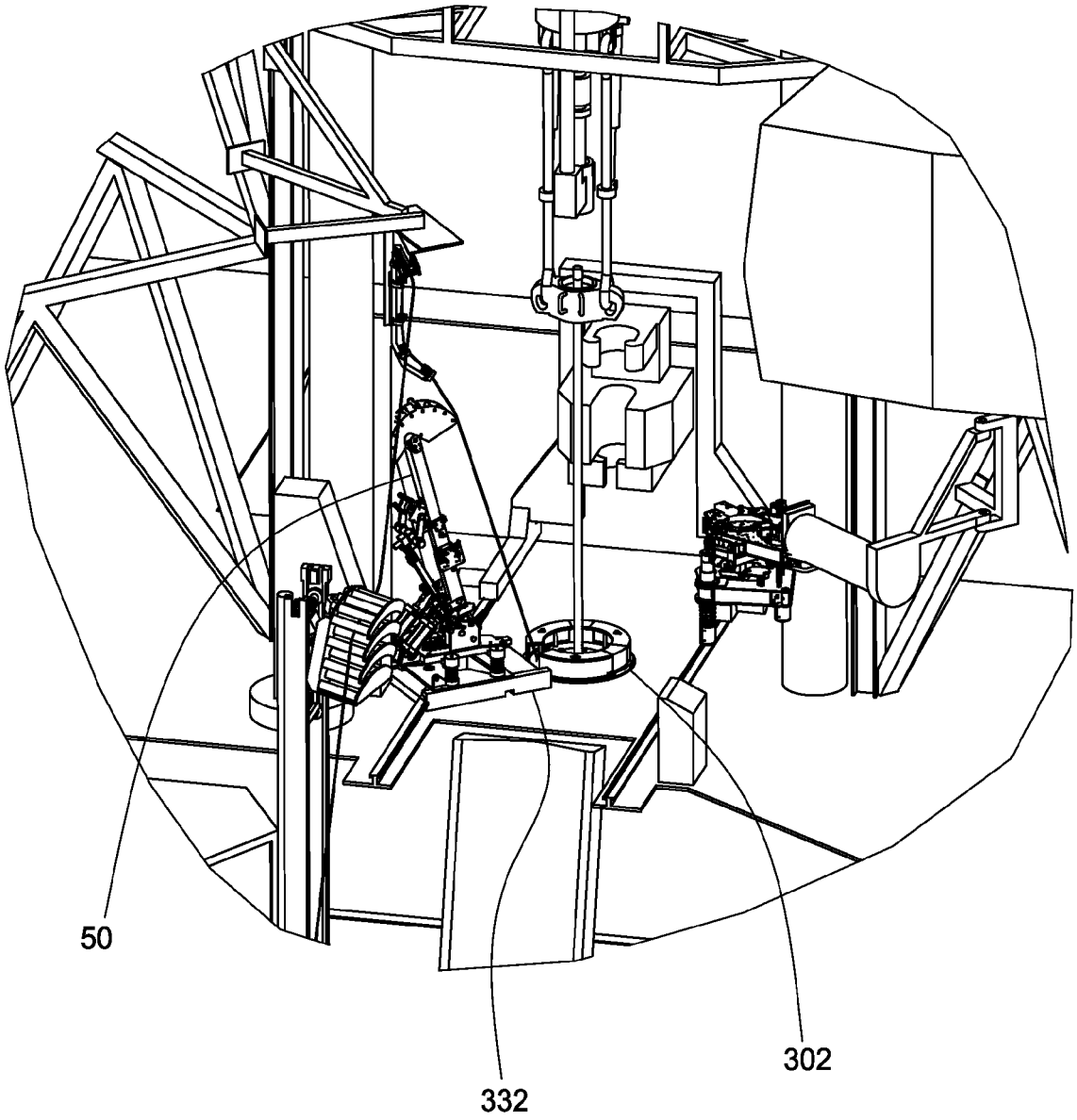
Figure 14:
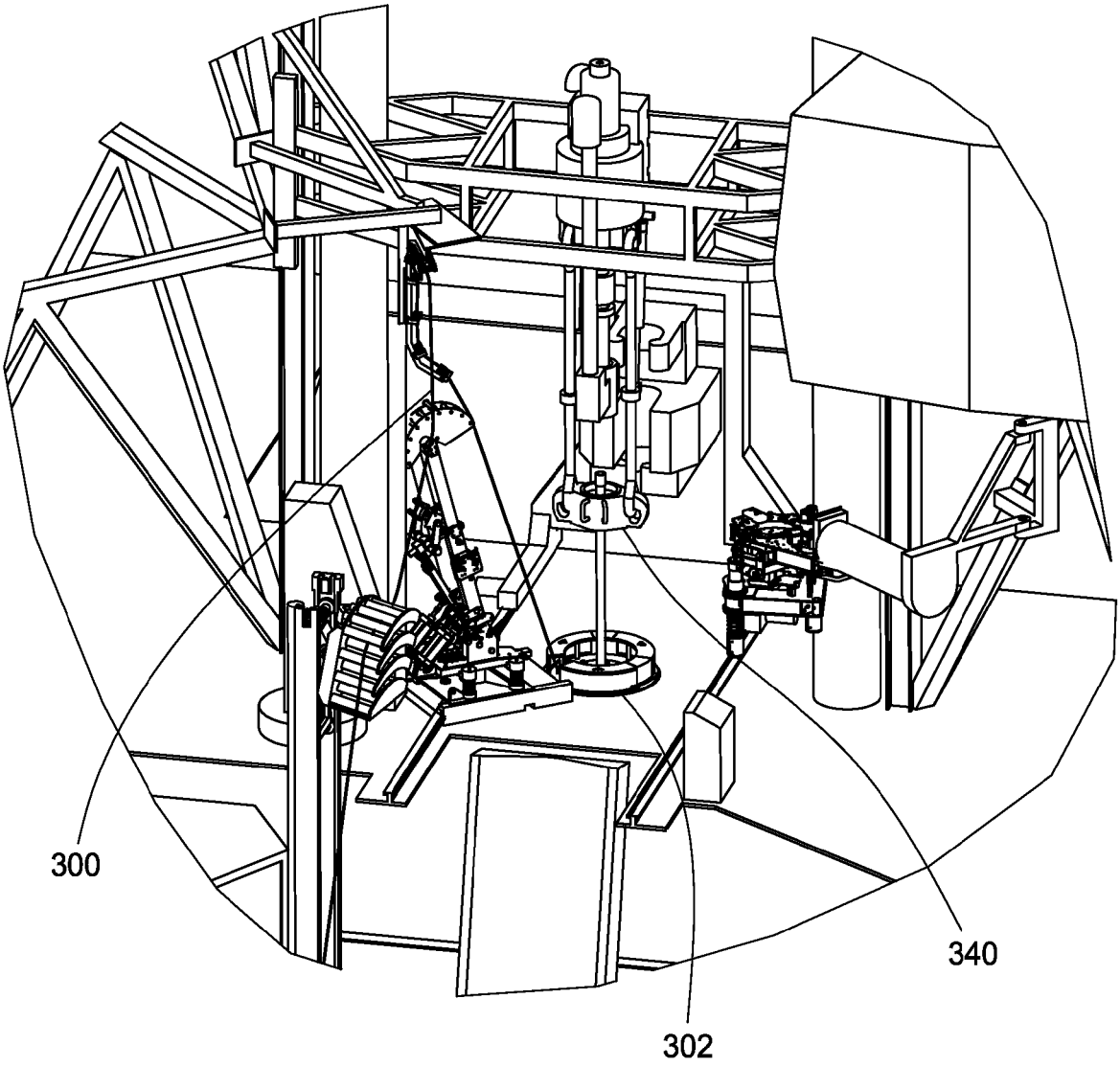

In FIG. 11, the tubular string 301 and the control line 300 are lowered into the well by the elevator 340. In FIG. 12, the manipulator assembly 50 is pivoted away from the tubular string 301, and the control line door in the spider 302 is closed to retain the control line in the safe area. In FIG. 13, the manipulator assembly 50 is optionally moved further away from the well center as the elevator is lowered. In FIG. 14, the slips of the spider 302 are closed to support the tubular string 301, and the elevator 340 is then released and hoisted in readiness to repeat the operation for a subsequent tubular section 303.

Control Line Cutting Device

A control line cutting device may be used to cut and control the free end of the control line. This may be activated in the event of a dropped tubular string. In one embodiment, the cutting device may be activated based on the speed of the control line unspooling from the cartridge. For example, the cutting device may be programmed to automatically cut the control line if the travel speed of the control line reaches or exceeds a predetermined limit. In another embodiment, a programmable controller may be used to control the cutting device. Alternatively, the cutting device may be programmed to allow the control line to be cut by operator activation if the travel speed of the control line reaches or exceeds a predetermined limit. The cutting device may be configured to grip the free end from the spool after the control line is cut. In another embodiment, the cutting device may be activated by an emergency button. The cutting device may be positioned at the cartridge, the spider, the guiding system, or any suitable location of the control line path. In one embodiment, the cartridge may be adapted to provide adequate spooling speed to follow a free-falling string while maintaining appropriate tension on the lines before cutting.

In another embodiment, the cutting device may include a shield to prevent whiplash of the control line once it has been severed. In the event of severance, one or more brakes may be activated after severing the control line in order to prevent further uncontrolled or unchecked travel of the remaining section of control line. Activation of the brakes may be initiated by the controller of the cutting device. In one embodiment, the brakes may be configured to allow travel of control line at less than a predetermined speed limit and to activate when the control line exceeds that limit.

While the foregoing is directed to embodiments of the present invention, other and further embodiments of the invention may be devised without departing from the basic scope thereof, and the scope thereof is determined by the claims that follow.

What is claimed is:

1. An apparatus for running a control line on a drilling rig, comprising:

a guide rail attached to the drilling rig and extends from below the rig floor to above the rig floor; and a guiding device having a channel for retaining the control line, wherein the guiding device is movable along the guide rail to a position above the rig floor and a position below the rig floor to raise or lower the control line to a predetermined location.

2. The apparatus of claim 1, wherein the guiding device includes one or more rollers.

3. The apparatus of claim 1, wherein the channel is adapted to allow insertion of the control line in a direction substantially transverse to a longitudinal axis of the control line.

4. The apparatus of claim 1, further comprising a second guiding device attached to a rig.

5. The apparatus of claim 4, wherein the second guiding device is adapted to change a path of the control line.

6. The apparatus of claim 4, wherein the second guiding device includes a plurality of rollers disposed on a directional arm.

7. A control line running system, comprising:

a control line storage unit;

a guiding system having a guiding device movable along a guide rail for raising or lowering a control line and for guiding the control line from the control line storage unit toward a well center;

a control line manipulator assembly for moving the control line toward a tubular; and a control line clamp for attaching the control line to the tubular.

8. The control line running system of claim 7, wherein the manipulator assembly includes a clamp boom for moving the control line clamp toward the control line and the tubular.

9. The control line running system of claim 7, wherein the manipulator assembly includes a clamp gripping device for retaining the clamp.

10. The control line running system of claim 9, further comprising a clamp storage unit adapted to deliver successive clamps to be gripped by the gripping device.

11. The control line running system of claim 9, wherein the clamp gripping device is adapted to position the clamp in substantial parallel alignment with an axis of the tubular string.

12. The control line running system of claim 9, wherein the clamp gripping device includes a tool for fastening the clamp against the control line and the tubular string.

13. The control line running system of claim 7, wherein the clamp includes a conformable material disposed on an interior surface of the clamp.

14. A method for guiding a control line, comprising:

inserting the control line into an elevation guiding device;

elevating the elevation guiding device along a rail to raise the control line from below the rig floor to above the rig floor; and guiding the control line through a directional guiding device, whereby a path of the control line is altered as the control line travels from an upper portion of the directional guiding device to a lower portion of the directional guiding device.

15. The method of claim 14, wherein inserting the control line comprises inserting the control line in a direction substantially transverse to a longitudinal axis of the control line.

16. The method of claim 14, wherein the control line is raised or lowered relative to the directional guiding device.

17. The method of claim 14, further comprising securing the control line from the directional guiding device to a tubular, and lowering the tubular and the control line into a wellbore.

18. An apparatus for running a control line on a rig, comprising:

a guide rail; and an elevation guiding device having a channel for retaining the control line, wherein the guiding device is movable along the guide rail to raise or lower the control line to or from a location below the rig floor and a location above the rig floor; and a directional guiding device attached to the rig and having a directional arm and a plurality of roller sets positioned along a longitudinal axis of the directional arm, wherein the directional guiding device is positioned to redirect the control line from the elevation guiding device and to alter a path of the control line as the control line travels from a first roller set at an upper portion of the directional arm to a second roller set at a lower portion of the directional arm.

19. The apparatus of claim 18, wherein the elevation guiding device includes one or more rollers.

20. The apparatus of claim 18, wherein the channel is adapted to allow insertion of the control line in a direction substantially transverse to a longitudinal axis of the control line.

21. The apparatus of claim 18, wherein the first roller set includes a pair of rollers and the control line is retained between the pair of rollers.

22. The apparatus of claim 18, wherein the direction guiding device is pivotable in one or more planes to adjust a directional angle of the directional arm.

23. The apparatus of claim 18, wherein the guiding device is movable relative to the directional guiding device.

24. A control line running system, comprising:

a control line storage unit;

a guiding system having a guiding device and a guide rail for guiding a control line from the control line storage unit toward a well center;

a control line manipulator assembly for moving the control line toward a tubular;

a control line clamp for attaching the control line to the tubular;

a clamp gripping device provided on the manipulator assembly for retaining the clamp gripping device; and a clamp storage unit adapted to deliver successive clamps to be gripped by the gripping device.

25. A control line running system, comprising:

a control line storage unit;

a guiding system having a guiding device and a guide rail for guiding a control line from the control line storage unit toward a well center;

a control line manipulator assembly for moving the control line toward a tubular;

a control line clamp for attaching the control line to the tubular; and a clamp gripping device provided on the manipulator assembly for retaining the clamp gripping device, wherein the clamp gripping device includes a tool for fastening the clamp against the control line and the tubular string.

* * * * *